US006014982A

United States Patent [19]

Strevey

[11] Patent Number: 6,014,982

[45] Date of Patent: Jan. 18, 2000

[54] PYRAMIDAL TENT-LIKE STRUCTURE

[76] Inventor: Darlene Strevey, 2036 Royal Fern Ct., 12A, Reston, Va. 20191

[21] Appl. No.: 08/856,287

[22] Filed: May 14, 1997

[51] Int. Cl.[7] ..... E04H 15/36

[52] U.S. Cl. ..... 135/124; 135/116; 135/119; 135/905

[58] Field of Search ..... 135/116, 124, 135/125, 156, 136, 118, 119, 905

[56] References Cited

U.S. PATENT DOCUMENTS

| | | | |
|---|---|---|---|
| 2,543,684 | 2/1951 | Blanchard | 135/156 X |
| 2,938,524 | 5/1960 | Benson | 135/156 X |
| 3,957,069 | 5/1976 | Denaro | 135/118 |
| 4,827,958 | 5/1989 | Cantwell et al. | 135/119 X |

*Primary Examiner*—Carl D. Friedman
*Assistant Examiner*—Winnie S. Yip
*Attorney, Agent, or Firm*—Fleshner & Kim

[57] ABSTRACT

A tent or tent-like structure which is inexpensive to produce and easily erected comprises a pair of continuous flexible support members or rods, each of which is bent into an approximately semi-circular configuration when the structure is assembled. The structure includes a substantially square base and four lateral faces to form a substantially pyramidal shaped canopy. Each end of each support member is retained by one of four retaining boots, each retaining boot affixed to the canopy adjacent to the base. Each support member is further retained by an apical retaining loop and a pair of lateral retaining loops located equidistant from the apical retaining loop and linearly arranged therewith. Tents according to the invention may be manufactured from suitable materials and of suitable size to render them fit for a wide range of purposes from a toy for a small child to a shelter for one or more adults. Methods of making such tent-like structures are also disclosed.

35 Claims, 29 Drawing Sheets

BASE

SCALE: BAR=6'

SCALE: BAR=6'

SCALE: BAR=6'

PYRAMIDAL TENT-LIKE STRUCTURE

BACKGROUND OF THE INVENTION

1. Field of the Invention

This invention relates to a simple, easily erected, tent-like structure of substantially pyramidal gross morphology which may be constructed of suitable materials and of appropriate size so as to be appropriate as a toy for a small child to play with. This invention also relates to a simple, easily-erected, tent-like structure of substantially pyramidal shape which may be constructed of suitable materials and of appropriate size so as to be appropriate as a play tent for children. This invention further relates to a simple, easily and quickly erectable, tent-like structure of substantially pyramidal gross morphology which may be constructed of suitable materials and of appropriate size so as to be appropriate as a shelter for adult humans or for animals. This invention still further relates to a method of making a simple, easily-erected, tent-like structure of substantially pyramidal gross morphology and ranging in size from that suitable as a toy for a small child to a size suitable for providing shelter for at least one adult human of at least average size.

2. Background of the Related Art

There is a need for a simple, easily erected tent or tent-like structure for providing shelter to civilian or military personnel, during camping expeditions, military maneuvers, and the like. There is also a need for a tent-like structure which can be easily erected by a child and can serve as a play tent, i.e. the play tent will accommodate at least one child. There is a further need for a tent-like structure which can be erected by a young child and can serve as a toy, i.e. the toy tent when erected will not accommodate even a young child, but will accommodate small toys such as stuffed or filled animals, toy furnishings, and the like. In each case there is the need for a tent-like structure, which is inexpensive to manufacture, which is quickly and easily dismantled or disassembled from the erect condition, and the components of which are easily stored during periods of decommission. The structure of the instant invention fulfills these needs, as will be described fully hereinbelow.

There have been a number of attempts to provide tents or tent-like structures which fulfill certain of the needs outlined above. None of these attempts teach a tent or tent-like structure having the features and/or advantages of Applicant's instant invention. For example, U.S. Pat. No. 3,960,161 to Norman discloses a portable structure comprising a fabric-like flexible sheet material and a frame member, wherein the frame member is restrained by (i.e. internal to) the fabric-like material. The frame member comprises a closed or continuous loop of material which is sufficiently flexible to allow it to be coiled. When the structure is in the erect position, the frame member has a shape generally corresponding to the periphery of a saddle. U.S. Pat. No. 3,990,463 also to Norman, discloses a portable structure which is related to the structure disclosed in the '161. However, the structure of the '463 comprises a frame member which may assume a figure-eight orientation. U.S. Pat. No. 4,265,259 to Gillis discloses a tent having an external framework of a plurality of stressed arcuate poles which support a membrane. The poles cross each other at a number of points. Each pole is comprised of a plurality of shorter rods, adjacent members of which are coupled at collar members. Collar members occur at each point where any two of the plurality of poles cross each other. U.S. Pat. No. 4,311,159 to Wunderlich discloses a tent or shelter which includes a fabric covering having a circular peripheral edge. Each of two channels in the peripheral edge receive a flexible support. A third flexible support provides vertical support to the shelter and is received by a third channel which extends across the middle of the fabric covering. Each flexible support comprises a plurality of segments. The ends of each of the flexible supports are attached to brackets located on opposite sides of the shelter. U.S. Pat. No. 5,137,044 to Brady discloses a flexible tent structure comprising a plurality of flexible, generally oval-shaped hoops. A fabric covering is attached to, and extends over the oval-shaped hoops. Each oval-shaped hoop collapses into three generally circular loops. U.S. Pat. No. 5,197,504 to Howe discloses a tent having a membrane suspended from a plurality of flexible poles. Each pole extends through a plurality of O-rings distributed about the outer membrane surface along a path. One end of each pole is securely attached to the membrane, even when the tent is disassembled. The other end of each pole is attached to the membrane when the tent is erected, but is detached from the membrane when the tent is disassembled. U.S. Pat. No. 5,205,086 to Heim discloses a tent having a floor, a flexible canopy, and a series of inflatable tubes. The inflatable tubes, in the inflated state, serve to support the canopy, and are removably attached to the canopy by a corresponding series of sleeves. The sleeves have a longitudinal slit by which the sleeves open to receive the inflated tubes. The sleeves are closed by hook and loop fasteners.

The instant invention provides a substantially pyramidal tent-like structure which can be provided in a range of sizes for numerous different purposes at relatively little expense on a per unit basis. Additional advantages of the tent-like structure of Applicant will become readily apparent from the following account thereof.

The above references are incorporated by reference herein where appropriate for appropriate teachings of additional or alternative details, features and/or technical background.

SUMMARY OF THE INVENTION

An object, therefore, of the invention is to provide a tent-like structure which is easily erected.

Another object of the invention is to provide a toy tent suitable for a young child to play with.

Another object of the invention is to provide a tent-like structure suitable as a play tent and which can accommodate one or more children.

Another object of the invention is to provide a tent-like structure which is suitable for providing shelter to one or more humans.

Another object of the invention is to provide a method for making a tent-like structure which is of simple construction and which is readily assembled and disassembled.

Another object of the invention is to provide a method for erecting a tent-like structure.

Another object of the invention is to provide a toy sleeping bag for insertion in a toy tent.

One advantage of the invention is that it provides an easily erected tent-like structure which includes a canopy supported by a pair of supports.

Another advantage of the invention is that it provides an easily erected tent-like structure which can be constructed in a range of different sizes and from a wide variety of different materials.

Another advantage of the invention is that it provides a tent-like structure which is relatively inexpensive to produce.

Another advantage of the invention is that it provides a tent-like structure which is easily disassembled and can be easily stored.

One feature of the invention is that it provides a tent-like structure which includes first and second support members each of which comprises a continuous flexible rod.

Another feature of the invention is that it provides a tent-like structure which includes a pyramidal canopy supported by first and second support members.

Another feature of the invention is that it provides a tent-like structure which includes a pyramidal canopy having four lateral faces, four lateral edges, an apex, and a base.

Another feature of the invention is that it provides a tent-like structure which may include an opening, door, or entry in one or more of the four lateral faces.

Another feature of the invention is that it provides a tent-like structure which includes a pyramidal canopy supported by first and second support members, wherein the first and second support members are external to the canopy.

Another feature of the invention is that it provides a tent-like structure which includes first and second support members each of which comprises a continuous flexible rod, and wherein the ratio of the length of each of the first and second support members to the diameter of each of the first and second support members is from about 50:1 to 120:1.

Another feature of the invention is that it provides a tent-like structure which includes first and second support members, a pyramidal canopy having four lateral faces, four lateral edges, an apex, and a base, wherein the ratio of the length of each of the first and second support members to the vertical distance of the apex of the canopy from the base of the structure ranges from about 2.5:1 to about 5:1.

Another feature of the invention is that it provides a tent-like structure which includes first and second support members, wherein each of the first and second support members is bent into a substantially semicircular configuration, and the first and second support members intersect each other at about a right angle in a horizontal plane, and at a position substantially immediately above the apex of the canopy.

Another feature of the invention is that it provides a toy sleeping bag including a toy sleeping bag top and a toy sleeping bag bottom, the former including an open area, and the latter including a gathered portion, and a folded and elasticated portion.

These and other objects, advantages and features are accomplished by the provision of a tent-like structure, including: a base having four sides of substantially equal length and four corners; a canopy having a substantially pyramidal shape, the canopy having four lateral edges, four basal edges, and an apex; an apical retaining loop secured to the canopy at substantially the apex of the canopy; four lateral retaining loops, one of the four lateral retaining loops secured to each of the four lateral edges of the canopy, and the four lateral retaining loops spaced equidistant from the apex of the canopy; four basal retaining boots, one of the four basal retaining boots secured to each of the four lateral edges at a location on each of the four lateral edges adjacent to each of the four corners of the base; and first and second support members each constructed of a continuous flexible rod, each of the first and second support members passing within and retained by the apical loop, each of the first and second support members passing within and retained by two of the lateral retaining loops, and each end of each of the first and second support members inserted into and retained by one of the four basal retaining boots, wherein the first and second support members io each form an arc and intersect at substantially a right angle in a horizontal plane of intersection, and at a point substantially immediately above the apex.

These and other objects, advantages and features are accomplished by the provision of a toy tent for a young child to play with, including: a base having four sides of substantially equal length and four corners, and each of the four sides has a length ranging from about 10 inches to about 60 inches; a canopy having a substantially pyramidal shape, the canopy having four lateral edges, four basal edges, and an apex; an apical retaining loop secured to the canopy at substantially the apex of the canopy; four lateral retaining loops, one of the four lateral retaining loops secured to each of the four lateral edges of the canopy, and the four lateral retaining loops spaced equidistant from the apex of the canopy; four basal retaining boots, one of the four basal retaining boots secured to each of the four lateral edges at a location on each of the four lateral edges adjacent to each of the four corners of the base; and first and second support members each constructed of a continuous flexible rod, each of the first and second support members passing within and retained by the apical loop, each of the first and second support members passing within and retained by two of the lateral retaining loops, and each end of each of the first and second support members inserted into and retained by one of the four basal retaining boots, wherein the first and second support members each have a length ranging from 20–100 inches, and wherein the first and second support members intersect at a point substantially immediately above the apex.

These and other objects, advantages and features are accomplished by the provision of a play tent for children to play inside, including: a base having four sides of substantially equal length and four corners; a canopy having a substantially pyramidal shape, the canopy having four lateral edges, four basal edges, and an apex; an apical retaining loop secured to the canopy at substantially the apex of the canopy; four lateral retaining loops, one of the four lateral retaining loops secured to each of the four lateral edges of the canopy, and the four lateral retaining loops spaced equidistant from the apex of the canopy; four basal retaining boots, one of the four basal retaining boots secured to each of the four lateral edges at a location on each of the four lateral edges adjacent to each of the four corners of the base; and first and second support members each constructed of a continuous flexible rod, each of the first and second support members passing within and retained by the apical loop, each of the first and second support members passing within and retained by two of the lateral retaining loops, and each end of each of the first and second support members inserted into and retained by one of the four basal retaining boots, wherein the first and second support members each have a length ranging from 100–200 inches, and wherein the first and second support members intersect at a point substantially immediately above the apex.

These and other objects, advantages and features are accomplished by the provision of a tent-like structure for human shelter, including: a base having four sides of substantially equal length and four corners; a canopy having a substantially pyramidal shape, the canopy having four lateral edges, four basal edges, and an apex; an apical retaining loop secured to the canopy at substantially the apex of the canopy; four lateral retaining loops, one of the four lateral retaining loops secured to each of the four lateral edges of the canopy, and the four lateral retaining loops spaced equidistant from the apex of the canopy; four basal retaining boots, one of the four basal retaining boots secured to each of the four lateral edges at a location on each of the four lateral edges adjacent to each of the four corners of the base; and first and second support members each constructed of a continuous flexible rod, each of the first and second support members passing within and retained by the apical loop, each of the first and second support members passing within and retained by two of the lateral retaining loops, and each end of each of the first and second support members inserted into and retained by one of the four basal retaining boots, wherein the first and second support members each have a length ranging from 8–72 feet, and a diameter ranging from 1.5–15 inches, and wherein the first and second support members intersect at a point substantially immediately above the apex.

These and other objects, advantages and features are accomplished by the provision of a method for making a tent-like structure including the steps of: providing a base, the base having four corners and four sides of substantially equal length; providing first, second, third, and fourth lateral faces of the structure, each of the first, second, third, and fourth lateral faces of equal size and each of the first, second, third, and fourth lateral faces having two lateral sides of equal length and a basal side; securing the basal side of the first lateral face to a first side of the base; securing the basal side of the second lateral face to a second side of the base; securing the basal side of the third lateral face to a third side of the base; securing the basal side of the fourth lateral face to a fourth side of the base; joining the lateral sides of the first, second, third, and fourth lateral sides to form a canopy of the tent-like structure, the canopy having first, second, third, and fourth lateral edges, the canopy further having an apex and the canopy substantially pyramidal in shape; providing an apical retaining loop; securing the apical retaining loop to the apex of the canopy; providing first, second, third, and fourth lateral retaining loops; securing the first, second, third, and fourth lateral retaining loops to the first, second, third, and fourth lateral edges, respectively, of the canopy; providing first, second, third, and fourth basal retaining boots; securing the first, second, third, and fourth basal retaining boots to the first, second, third, and fourth lateral edges, respectively, of the canopy at a position on the first, second, third, and fourth lateral edges adjacent to the base; and providing first and second support members.

These and other objects, advantages and features are accomplished by the provision of a method of erecting a tent-like structure, including the steps of: providing a base, the base having four corners and four sides of substantially equal length, the four sides forming a perimeter of the base; providing a canopy including first, second, third, and fourth lateral faces, each of the first, second, third, and fourth lateral faces of equal size and each of the first, second, third, and fourth lateral faces having two lateral sides of equal length and a basal side, the basal side of the first, second, third, and fourth lateral faces attached to the perimeter of the base, and the canopy further having first, second, third, and fourth lateral edges, the canopy further having an apex and the canopy substantially pyramidal in shape, an apical retaining loop attached to the canopy at the apex, and the canopy further having first, second, third, and fourth lateral retaining loops secured to the first, second, third, and fourth lateral edges, respectively, of the canopy, and the canopy further having first, second, third, and fourth basal retaining boots secured to the first, second, third, and fourth lateral edges, respectively, of the canopy at a position on the first, second, third, and fourth lateral edges adjacent to the base; providing first and second support members, each of the first and second support members having a first end and a second end; passing the first support member through the first lateral retaining loop, through the apical retaining loop, and through the third lateral retaining loop; passing the second support member through the second lateral retaining loop, through the apical retaining loop, and through the fourth lateral retaining loop; inserting the first and second ends of the first support member into the first basal retaining boot and the third basal retaining boot; and inserting the first and second ends of the second support member into the second basal retaining boot and the fourth basal retaining boot.

These and other objects, advantages and features are accomplished by the provision of a method of erecting a tent-like structure, including the steps of: providing a base, the base having four corners and four sides of substantially equal length, the four sides forming a perimeter of the base; providing a canopy including first, second, third, and fourth lateral faces, each of the first, second, third, and fourth lateral faces of equal size and each of the first, second, third, and fourth lateral faces having two lateral sides of equal length and a basal side, the basal side of the first, second, third, and fourth lateral faces attached to the perimeter of the base, and the canopy further having first, second, third, and fourth lateral edges, the canopy further having an apex and the canopy substantially pyramidal in shape, an apical retaining loop attached to the canopy at the apex, and the canopy further having first, second, third, and fourth lateral retaining loops secured to the first, second, third, and fourth lateral edges, respectively, of the canopy, and the canopy further having first, second, third, and fourth basal retaining boots secured to the first, second, third, and fourth lateral edges, respectively, of the canopy at a position on the first, second, third, and fourth lateral edges adjacent to the base; providing first and second support members, each of the first and second support members having a first end and a second end; passing the first end of the first support member through the first lateral retaining loop; passing the first end of the first support member through the apical retaining loop; passing the first end of the first support member through the third lateral retaining loop; passing the first end of the second support member through the second lateral retaining loop; passing the first end of the second support member through the apical retaining loop; passing the first end of the second support member through the fourth lateral retaining loop; inserting the first end and the second end of the first support member into the first basal retaining boot and the third basal retaining boot, respectively; and inserting the first end and the second end of the second support member into the second basal retaining boot and the fourth basal retaining boot, respectively.

These and other objects, advantages and features will become more apparent from the following description of embodiments thereof taken in conjunction with the accompanying drawings.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIGS. 4A and 4B show the relationship between internal and external diameter of a hollow rod or tube which may act as a support member of a tent, according to one embodiment of the invention, in which FIG. 4A is a sectional view and FIG. 4B is a perspective view;

DETAILED DESCRIPTION OF PREFERRED EMBODIMENTS

Figure 1:
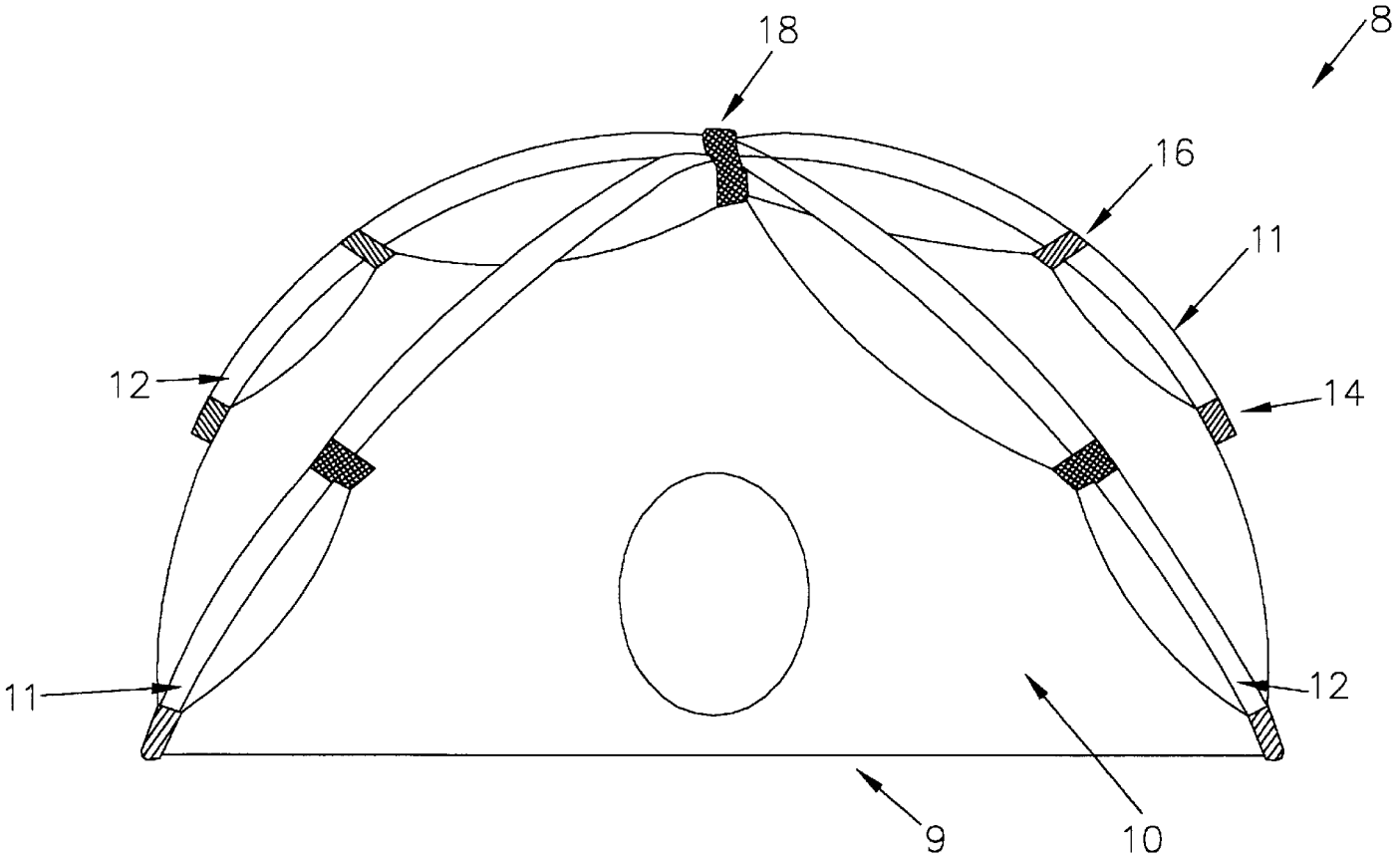
FIG. 1 shows a frontal perspective view of a tent or tent-like structure, according to one embodiment of the invention.

In describing tents of the instant invention, the description refers to the tent in the assembled state or erect position, unless specified otherwise. Referring to the drawings, FIG. 1 shows a frontal perspective view of a tent or tent-like structure, according to one embodiment of the invention. Herein the terms "tent" and "structure" will be used synonymously. The tent or structure 8 of the instant invention has first and second supports or support members 11 and 12, respectively, which lie external to and provide support for a canopy 10 of tent 8. First and second support members 11, 12 intersect at, or within an apical retaining loop 18 of tent 8, at approximately a right angle or 90° in the horizontal plane at the point of intersection. A base or base member 9 has four base sides 9*a–d* of approximately equal length (FIG. 2A) and four corners (9*e–h*) (FIG. 2B). Tent 8 may be provided in a range of sizes, from a tent 8 which is only a few inches in height and which is suitable as a toy for a small child, to a tent 8 which has a height of several feet and which is suitable for sheltering or accommodating a number of human adults and/or children.

The size of base 9 and the length of support members 11, 12 of tent 8 are to a large extent proportional to the height of tent 8. Variations in the ratio of the size of base 9 to the length of each support member 11, 12, and the ratios of other components to each other will account for some differences in overall shape of canopy 10 and tent 8, the taughtness of the canopy, etc. The effects of such variations in the ratios of the dimensions of certain components to the dimensions of other components of tent 8 may be used to advantage in the practice of the invention to provide a tent having certain desirable features, such as overall canopy shape, and taughtness of the canopy. At the same time, restrictions of the ratios of the dimensions of various components of tent 8 within certain ranges are inherent in the invention, as will be related hereinbelow. Choice of materials used in construction of base 9, canopy 10, and support members 11, 12 may also influence the overall shape and degree of taughtness of the canopy. Again, materials may be selected to provide a tent having certain features according to consumer preferences within the broad scope of tent 8 as disclosed herein.

Figure 2A:
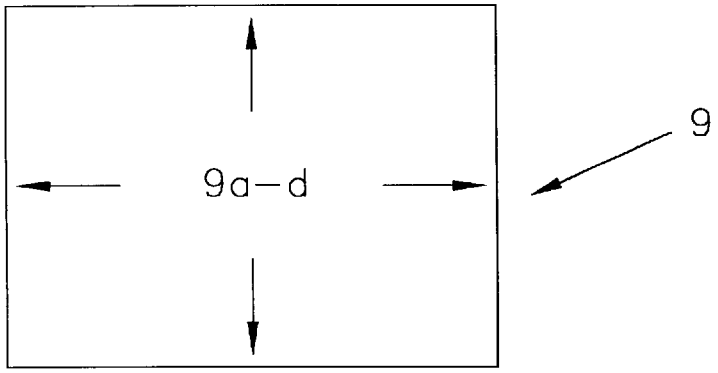
FIGS. 2A–2C show the basic shape of a four-sided base of a tent, which may range from substantially square (FIG. 2A), to having slightly concave curvature on each side (FIG. 2B), to more pronounced concave curvature (FIG. 2C), according to one embodiment of the invention.
Figure 2B:
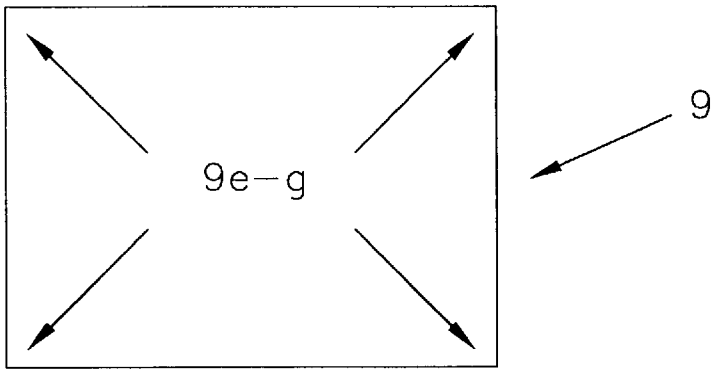
Figure 2C:
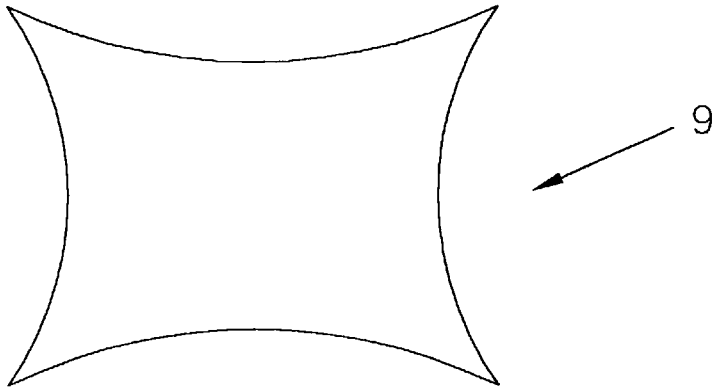

FIGS. 2A–2C show the basic shape of the four-sided base 9 of tent 8, in which all four sides 9*a–d* are the same length or substantially the same length. Base 9 may range from being square or substantially square in shape having four sides 9*a–d* which are substantially straight (FIG. 2A), to having slightly concave curvature on each side 9*a–d* (FIG. 2B), to having more pronounced concave curvature on each side 9*a–d* (FIG. 2C).

Figure 3A:
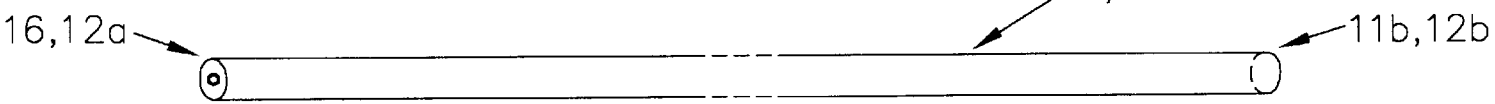
FIGS. 3A–3C show a continuous length of flexible hollow rod or tube which may act as a support for a tent, in a substantially straight configuration (FIG. 3A), in a slightly curved configuration (FIG. 3B), and in a more curved configuration (FIG. 3C), according to one embodiment of the invention.
Figure 3B:
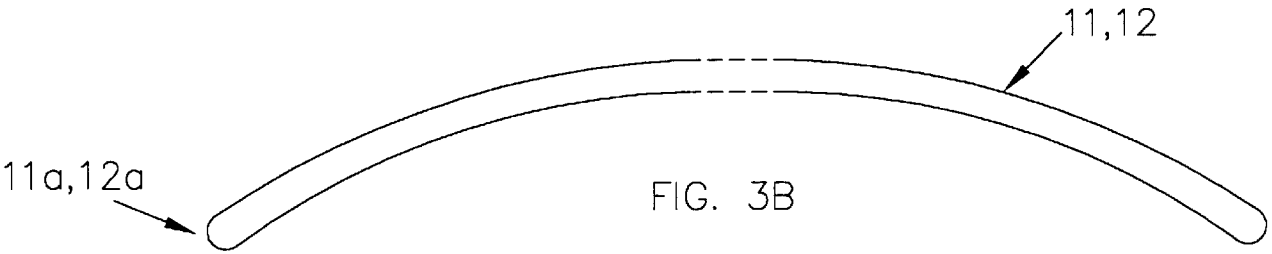
Figure 3C:
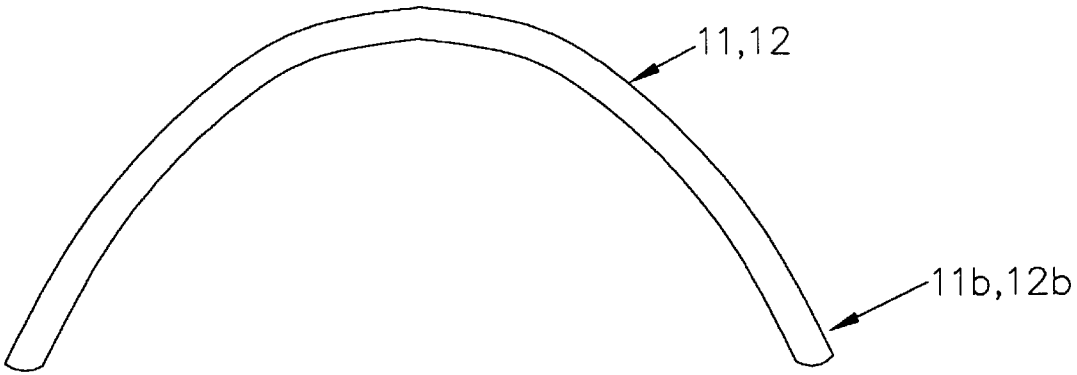

FIGS. 3A–3C show a continuous length of flexible rod which may act as first and second support members 11, 12 for tent 8, with support member 11,12 in a substantially straight configuration (FIG. 3A), in a slightly curved configuration (FIG. 3B), and in a more curved to approximately semi-circular configuration (FIG. 3C), according to the invention. Support members 11, 12 may comprise a continuous length of flexible hollow rod or tube, or may comprise a continuous length of flexible solid rod. First and second support members 11, 12 may be constructed of rods of different external and/or internal diameter, and/or may be constructed of different materials, i.e. first support member 11 may have a different internal diameter, a different external diameter, and be constructed of a different material as compared with second support member.

First and second support members 11, 12 may be the same length, substantially the same length, or the two support members may be purposely provided in somewhat different lengths. The relative size of first and second support members may effect the overall shape of tent 8 when erected. In one preferred embodiment, first and second support members 11, 12 are identical or nearly identical to each other with respect to length, internal diameter, external diameter, and materials of construction.

The flexible hollow or solid rods which comprise first and second support members 11, 12 should be sufficiently flexible, when cut to a desired length, to allow each support 11, 12 to be bent into a substantially semi-circular configuration without risk of breaking, and should retain sufficient strength to jointly support canopy 10 when bent to such a configuration. First and second support members 11, 12 may comprise various types of polymers or plastic materials, such as polyvinylchloride (PVC), or various types of wood, or other flexible synthetic or natural materials.

When a length of continuous hollow or solid rod is cut to provide a first or second support member 11, 12 it may have a substantially straight configuration as shown in FIG. 3A. After tent 8 has been assembled to incorporate first and second support members 11, 12, support members 11, 12 will generally assume a curved or arcuate configuration, which may approximate a semi-circular configuration, as shown in FIG. 3C. After tent 8 has been disassembled, first and second support members 11, 12 may assume a somewhat less curved configuration than that held while tent 8 is erect, which may approximate a gentle arc configuration, as shown in FIG. 3B.

Figure 3D:
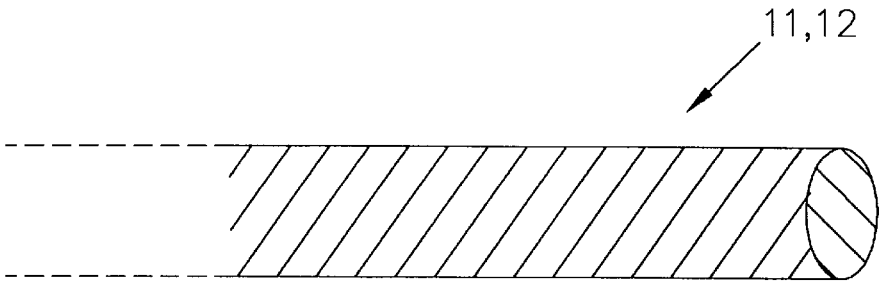
FIGS. 3D–3F show the ends of support members which are blunt, rounded, and pointed, respectively, according to the invention.
Figure 3E:
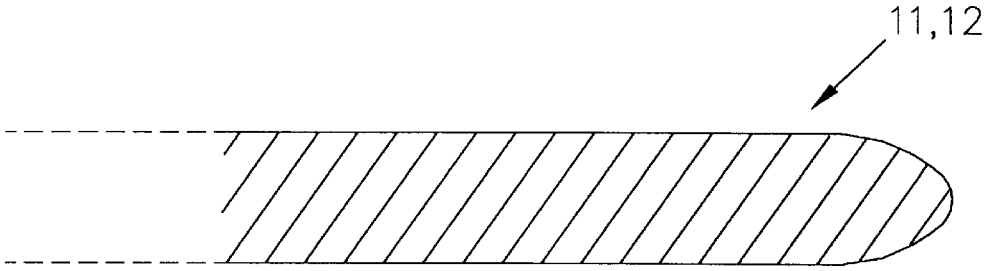
Figure 3F:
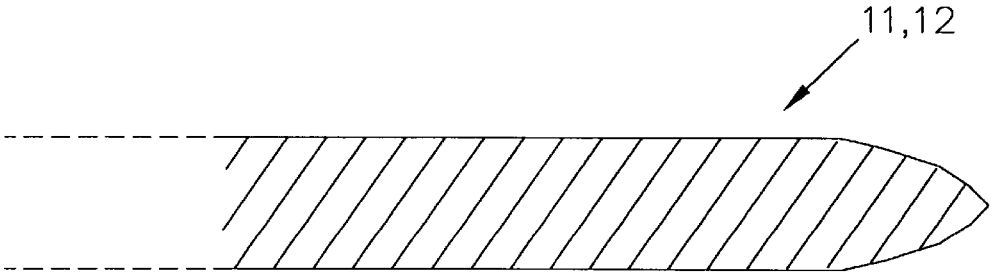

One or both ends of first and second support members 11, 12 may be substantially blunt, or may be rounded or sharpened to varying degrees. FIGS. 3D, 3E, and 3F show support members 11, 12 with an end which is substantially blunt, rounded, and somewhat pointed, respectively. These are merely representative of the kinds of shapes that ends of support member may assume, and other shapes are possible under the invention. A rounded or somewhat pointed end of a support member 11, 12 may facilitate passing or threading support members 11, 12 within apical retaining loop 18 and lateral retaining loops 16*a–d,* and may also facilitate insertion of support members 11, 12 into basal retaining boots 14*a–d.* However, a support member 11, 12 should not have a sharply pointed end due to the risk that such a pointed end may readily puncture one or more components of tent 8, such as canopy 10.

Figure 4A:
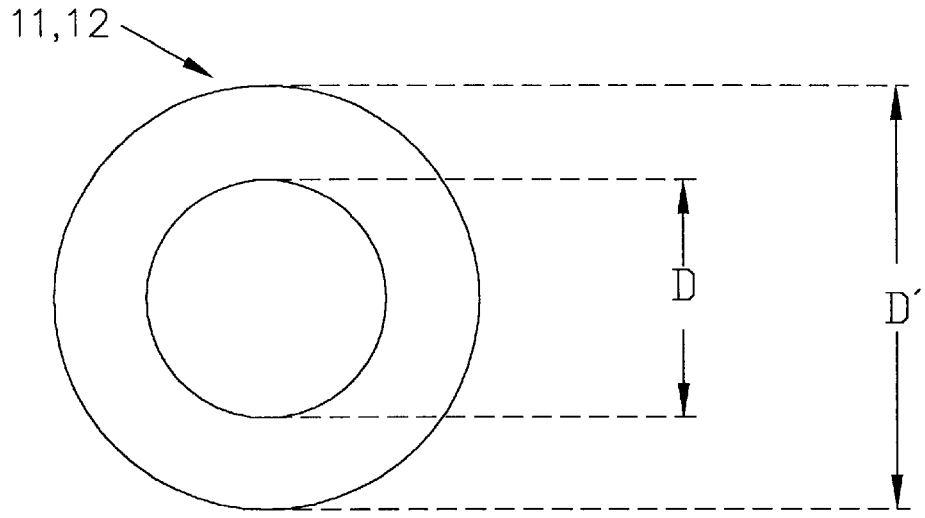
Figure 4B:
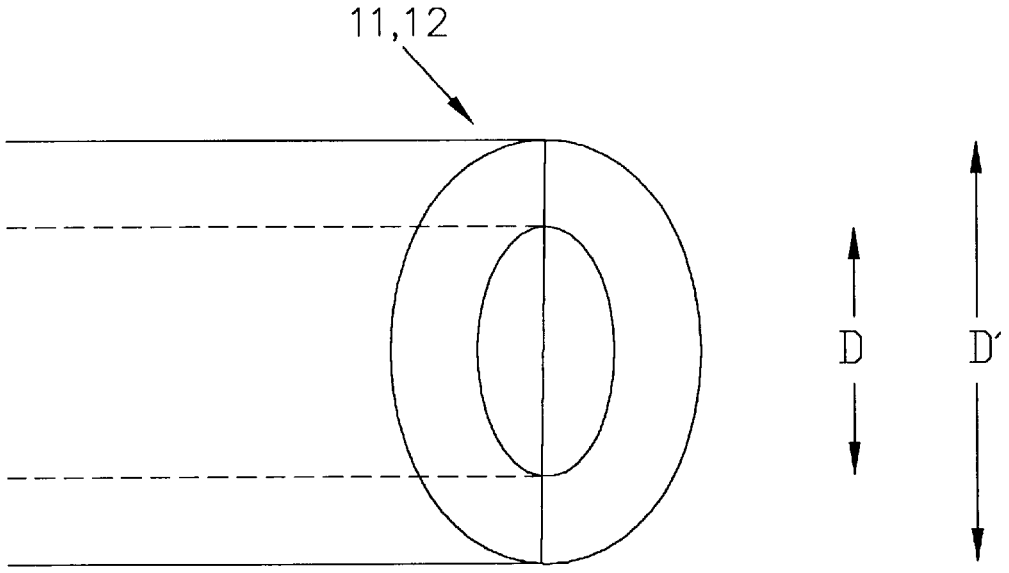

FIGS. 4A–4B show the relationship between internal diameter and external diameter of a hollow rod or tube which may act as a support member 11, 12 of tent 8, in which FIG. 4A is a sectional view and FIG. 4B is a perspective view of such a hollow rod. The term "diameter" as used herein denotes overall diameter or external diameter of a solid or hollow rod or support, unless otherwise specified.

The strength and flexibility of a hollow rod constructed of a given material is a function not only of the overall diameter or external diameter D', but is also a function of the ratio between the internal diameter D to the external diameter D' (D:D'). For a rod of a given material and a constant external diameter, the smaller the D:D' ratio, the greater the strength, the lower the degree of flexibility. Thus, by careful selection of a value for D as well as the D:D' ratio, support members of appropriate strength and flexibility can be provided for a given support member length.

Figure 5A:
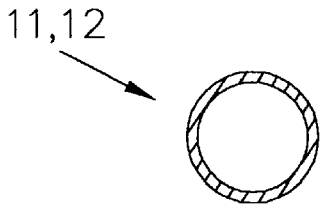
FIGS. 5A–5C shows sectional views of hollow rods which may act as a support for a tent according to one embodiment of the invention, in which the ratio of the internal diameter to the external diameter of the hollow rods decreases sequentially from FIG. 5A to FIG. 5C.
Figure 5B:
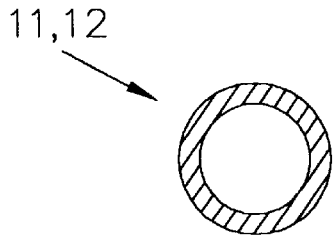
Figure 5C:
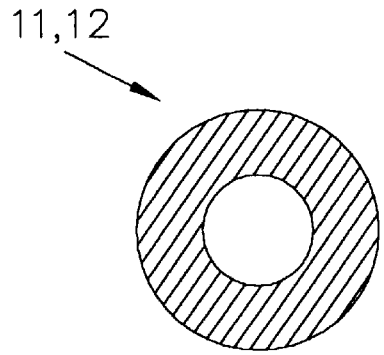
Figure 5D:
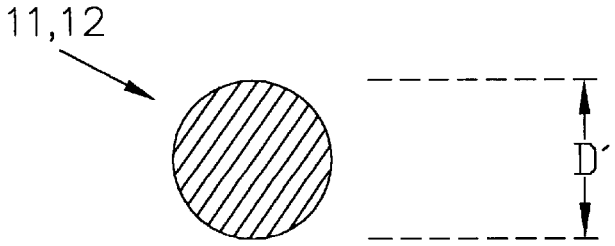
FIG. 5D shows a sectional view of a solid rod which may act as a support for a tent according to another embodiment of the invention.

FIGS. 5A–C shows sectional views of hollow rods which may act as a support for a tent according to one embodiment of the invention, in which the ratio of the internal diameter to the external diameter of the hollow rods decreases sequentially from FIG. 4A to FIG. 4C. As alluded t above, for a given construction material of hollow rods which may comprise first and second support members 11, 12, the degree of flexibility as well as strength of the rod is a function of the ratio of the internal diameter to the external diameter. Alternatively, according to another embodiment of the invention, first and second support members 11, 12 may be constructed of a flexible solid rod of suitable material and overall diameter D', as shown in FIG. 5D.

Figure 6A:
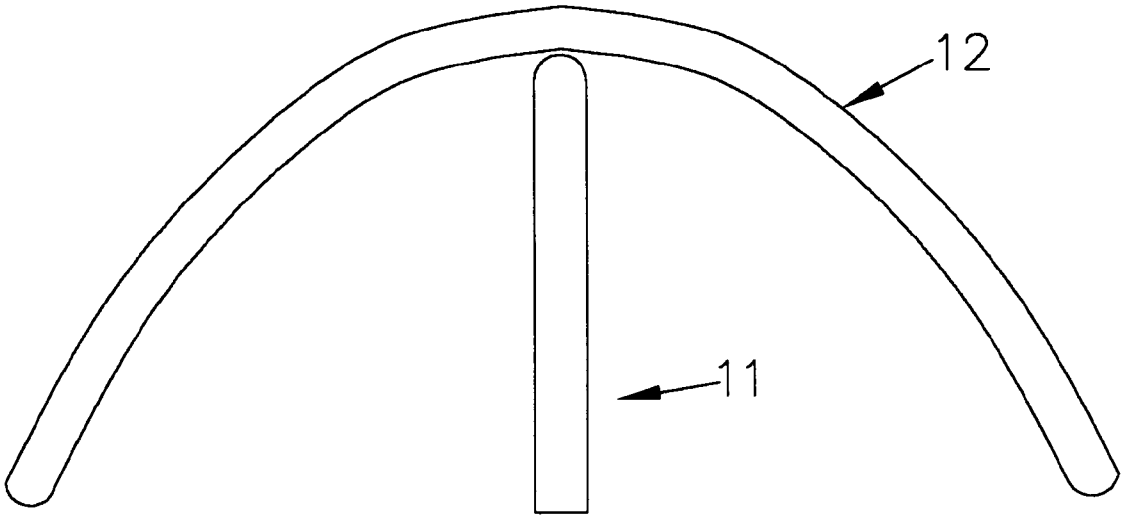
FIG. 6A is a side view showing the relative orientation of first and second support members for a tent in the erect position, with the canopy of the tent omitted for the sake of clarity, according to one embodiment of the invention.

FIG. 6A shows the relative orientation of a pair of supports for a tent in the erect position, in which first support member 11 passes underneath and intersects with second support member 12, the intersection being at approximately a right angle (when viewed from above). The canopy 10 (FIGS. 1, 6B) is omitted from FIG. 6A for the sake of clarity.

At the point of intersection, support member 12 may make contact with, and may be supported to some extent by, first support member 11.

Figure 6B:
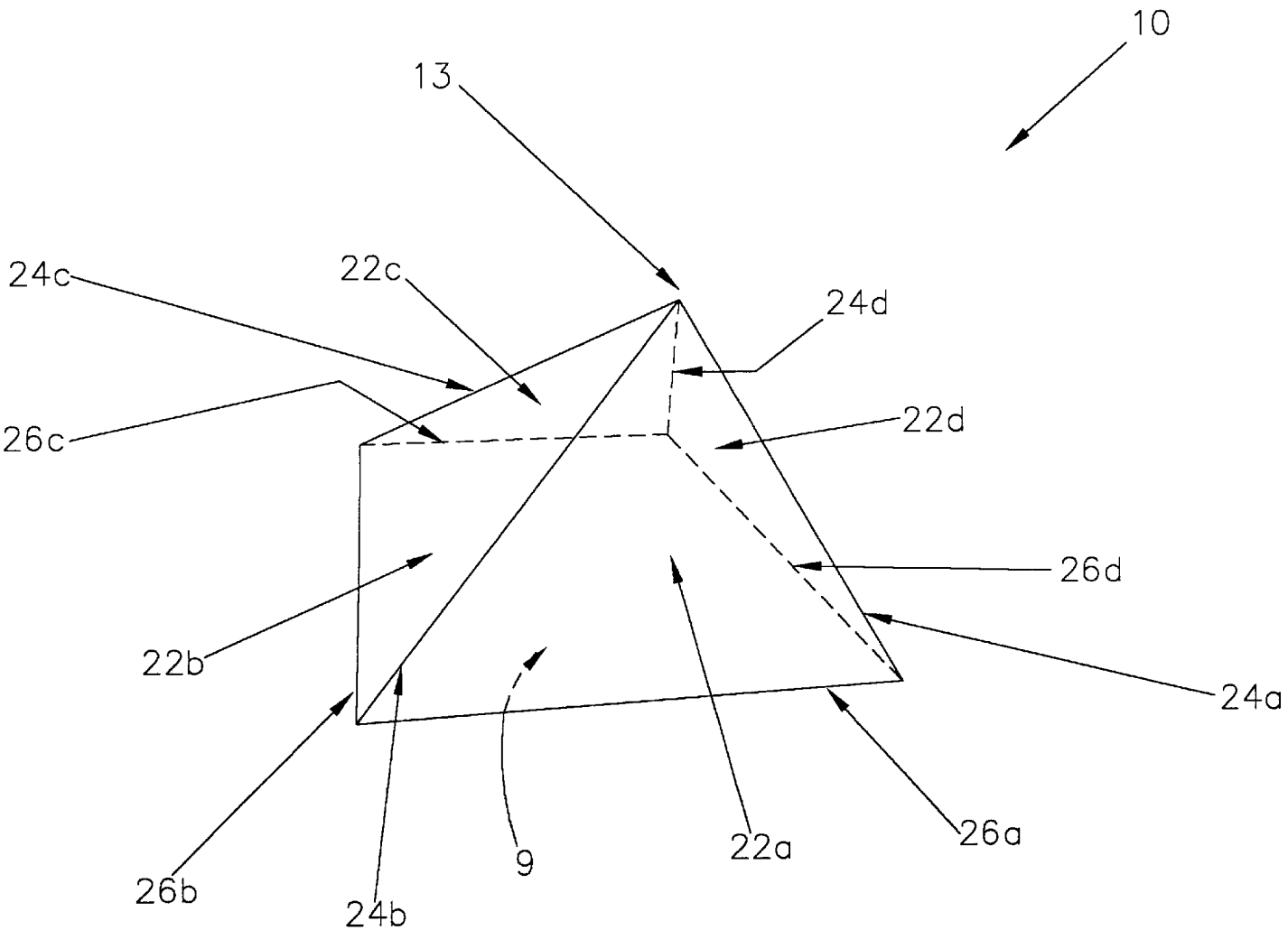
FIG. 6B is a schematic representation of the canopy and base of a tent in the erect position, with the supports of the tent omitted for the sake of clarity, according to one embodiment of the invention.

FIG. 6B is a schematic representation of canopy 10 of tent 8 (FIG. 1) in the erect position, showing the relative positions of base 9; first, second, third, and fourth lateral faces 22*a–d,* respectively; first, second, third, and fourth lateral edges 24*a–d,* respectively; first, second, third, and fourth basal edges, 26*a–d* respectively; and apex 13. First and second support members 11, 12 (FIGS. 1, 6A) are omitted from FIG. 6B for the sake of clarity. Each of lateral faces 22*a–d* comprise a basal side 21 and left and right lateral sides 23*a,b* respectively FIGS. 7A–D. Preferably left and right lateral sides 23*a,b* of each of lateral faces 22*a–d* are of equal length. Basal side 21 of first-fourth lateral faces 22*a–d* coincide with, or become, basal edges 26*a–d* of canopy 10 when lateral faces 22*a–d* are combined to form canopy 10.

Figure 7A:
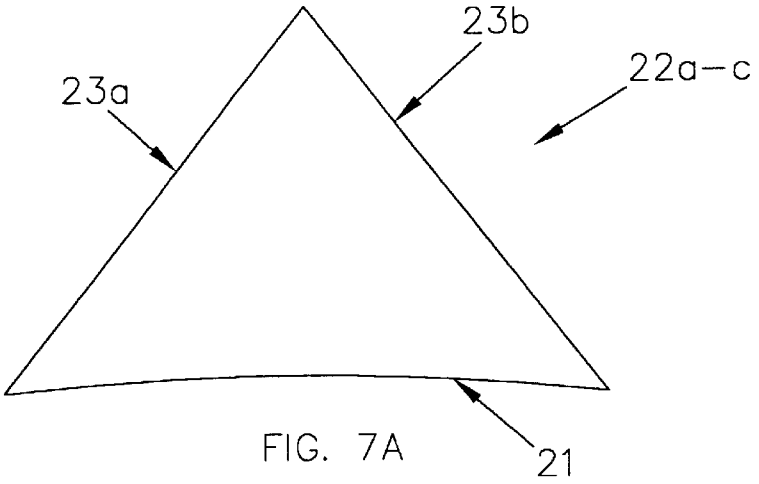
FIGS. 7A and 7B schematically represent a lateral face of a tent in the disassembled or non-erect position, and in the assembled or erect position, respectively, according to one embodiment of the invention.
Figure 7B:
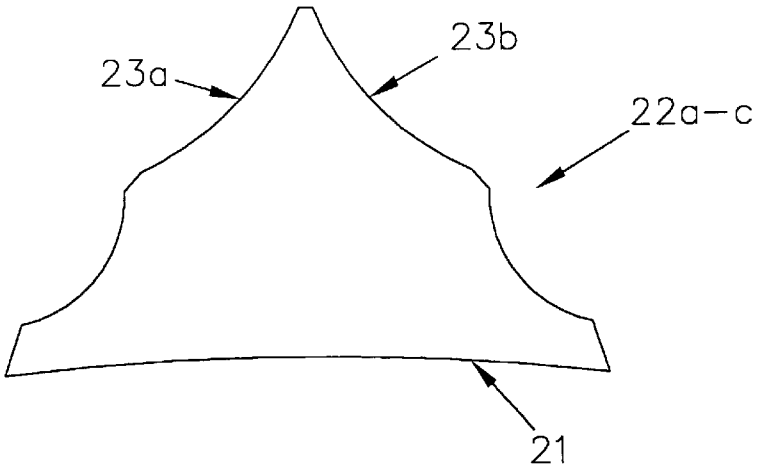

FIG. 7A schematically represents first, second, or third lateral face 22*a–c* of tent 8 in the disassembled or non-erect position, with lateral face 22*a–c* laid out completely flat in order to clearly show the overall shape of lateral faces 22*a–c*. FIG. 7B schematically represents first, second, or third lateral face 22*a–c* of tent 8 in the assembled or erect position, and demonstrates the type of distortion of left and right sides 23*a,b* by tension exerted thereon by apical retaining loop 18, lateral retaining loops 16*a–d,* and basal retaining boots 14*a–d.*

Figure 7C:
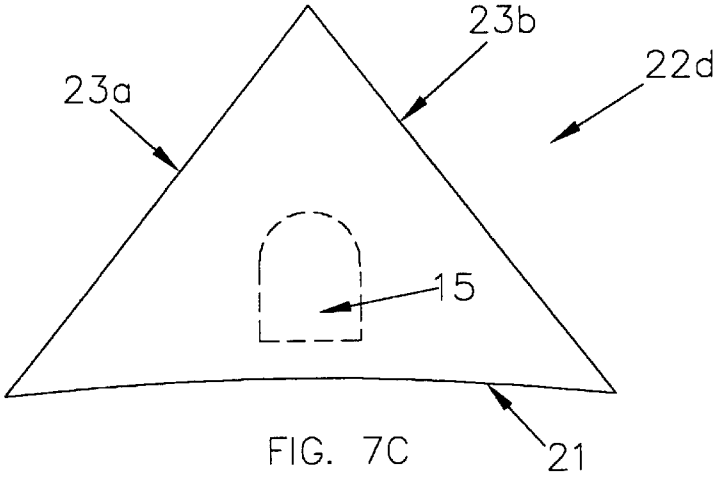
FIGS. 7C and 7D schematically represent a lateral face of a tent, the lateral face including an opening or entry, with the tent in the disassembled or non-erect position, and in the assembled or erect position, respectively, according to one embodiment of the invention.
Figure 7D:
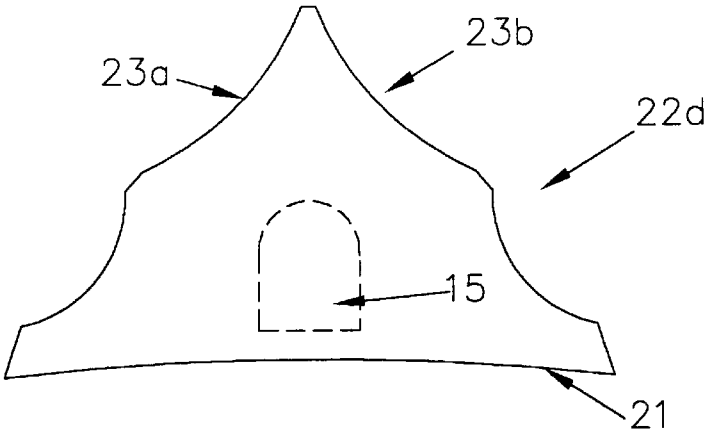

FIGS. 7C and 7D schematically represent fourth lateral face 22*d* of tent 8 in the disassembled or non-erect position, and fourth lateral face 22*d* of tent 8 in the assembled or erect position, respectively, showing features analogous to those of lateral faces 22*a–c* of FIGS. 7A, 7B. However, according to one embodiment of the invention, fourth lateral face 22*d* of tent 8 includes a door, portal or entry 15.

Figure 8:
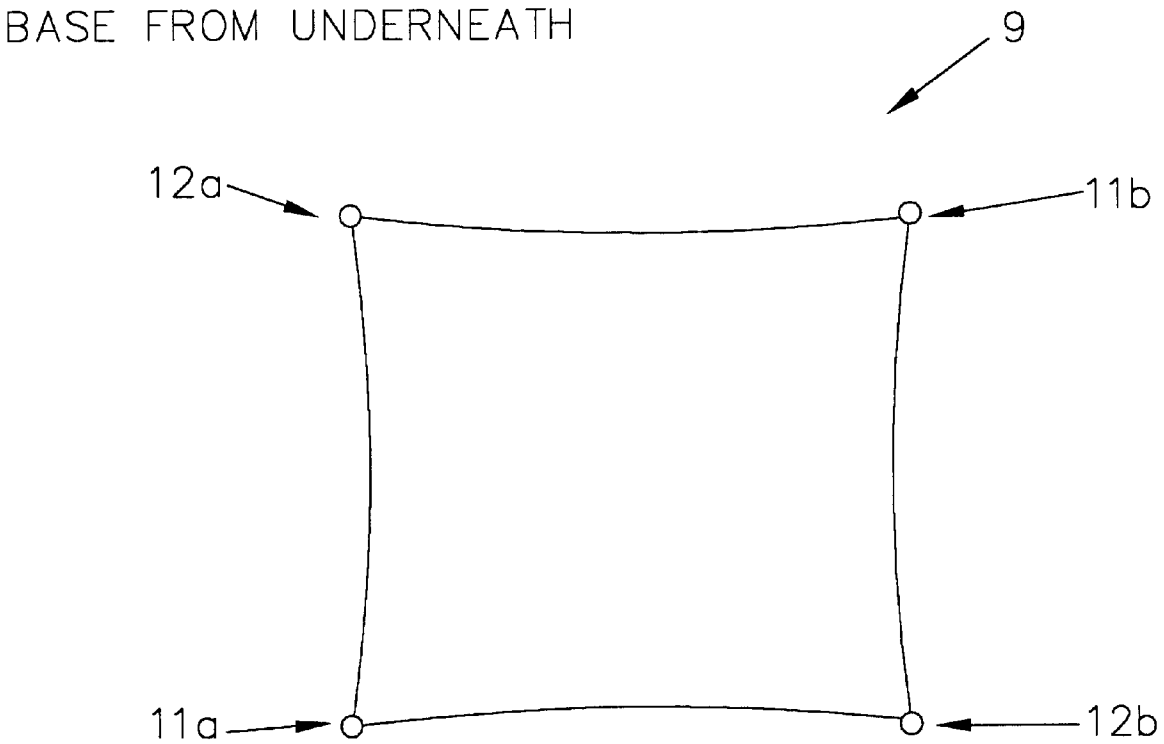
FIG. 8 schematically represents a four-sided base of a tent as seen from underneath the tent showing the positions of the ends of the two supports, according to another embodiment of the invention.

FIG. 8 schematically represents base member 9 of tent 8 as seen from underneath the tent showing the positions of first and second ends 11*a,* 11*b,* respectively, of first support member 11, and first and second ends 12*a,* 12*b,* respectively, of second support member 12. Base member 9 may be constructed of a suitable pliable material or fabric of suitable construction and thickness concomitant with the purpose or utility of tent 8. Naturally, the degree of softness, water resistance, insulation, cushioning, and the like can be varied over a broad range of fabrics and other materials, both natural and artificial, which may be laminated or layered as appropriate. Similarly, the degree and type of color, and the presence or absence of a particular type of pattern, of material comprising base member 9 may also be varied according to consumer preferences consistent with the designated function or type of tent, e.g. as a toy, play tent, or shelter for military or civilian outdoor use, etc.

Figure 9:
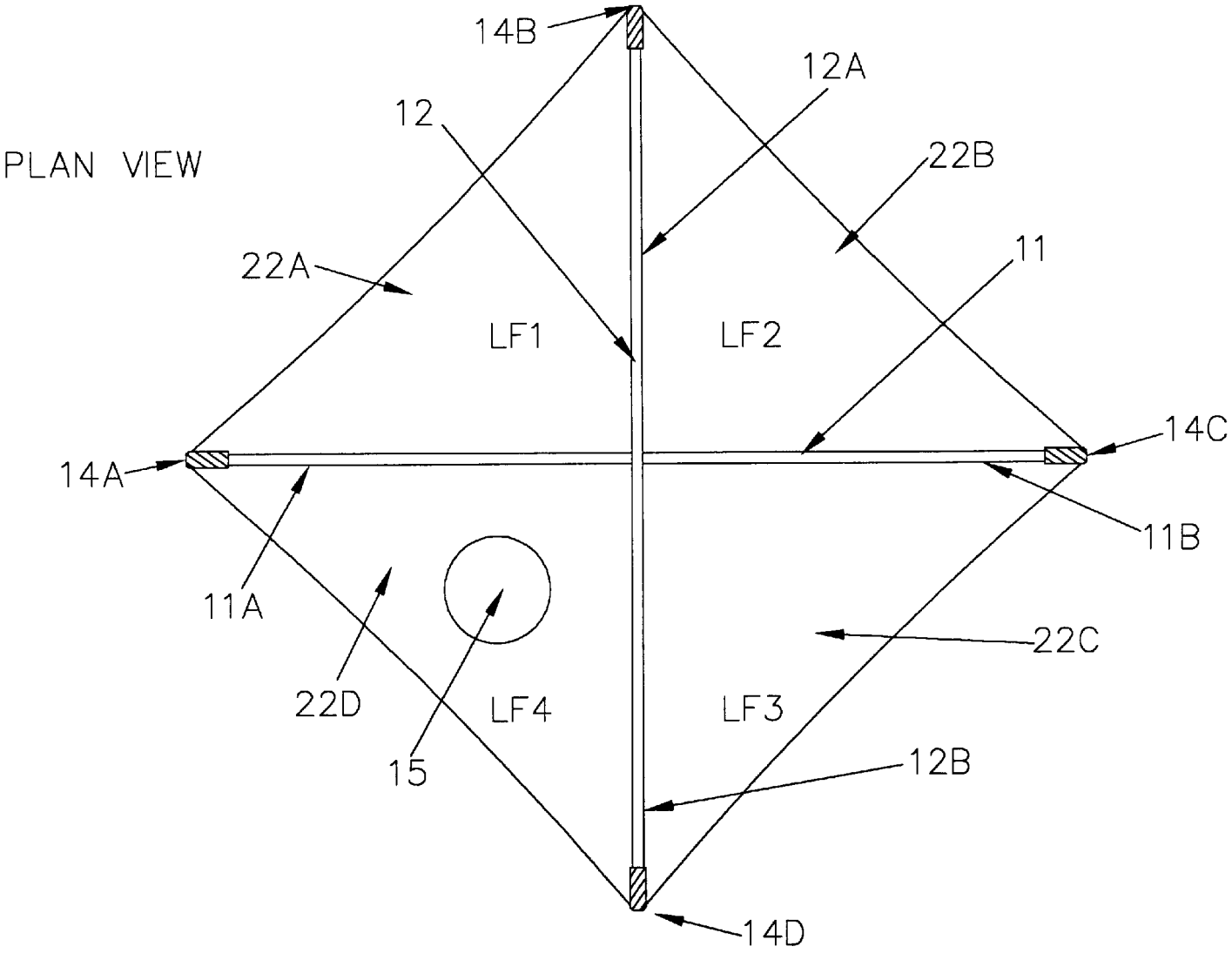
FIG. 9 is a plan view of a tent in the erect position showing the intersection of the two supports, the four lateral faces and the position of the four basal retaining boots, according to another embodiment of the invention.

FIG. 9 is a plan view of tent 8 in the erect position showing the relationship or relative positions of various components of tent 8, including intersecting first and second support members 11, 12, respectively; first, second, third, and fourth lateral faces, 22*a–d,* respectively; first, second, third, and fourth basal retaining boots, 14*a–d,* respectively; and entry 15.

Figure 10:
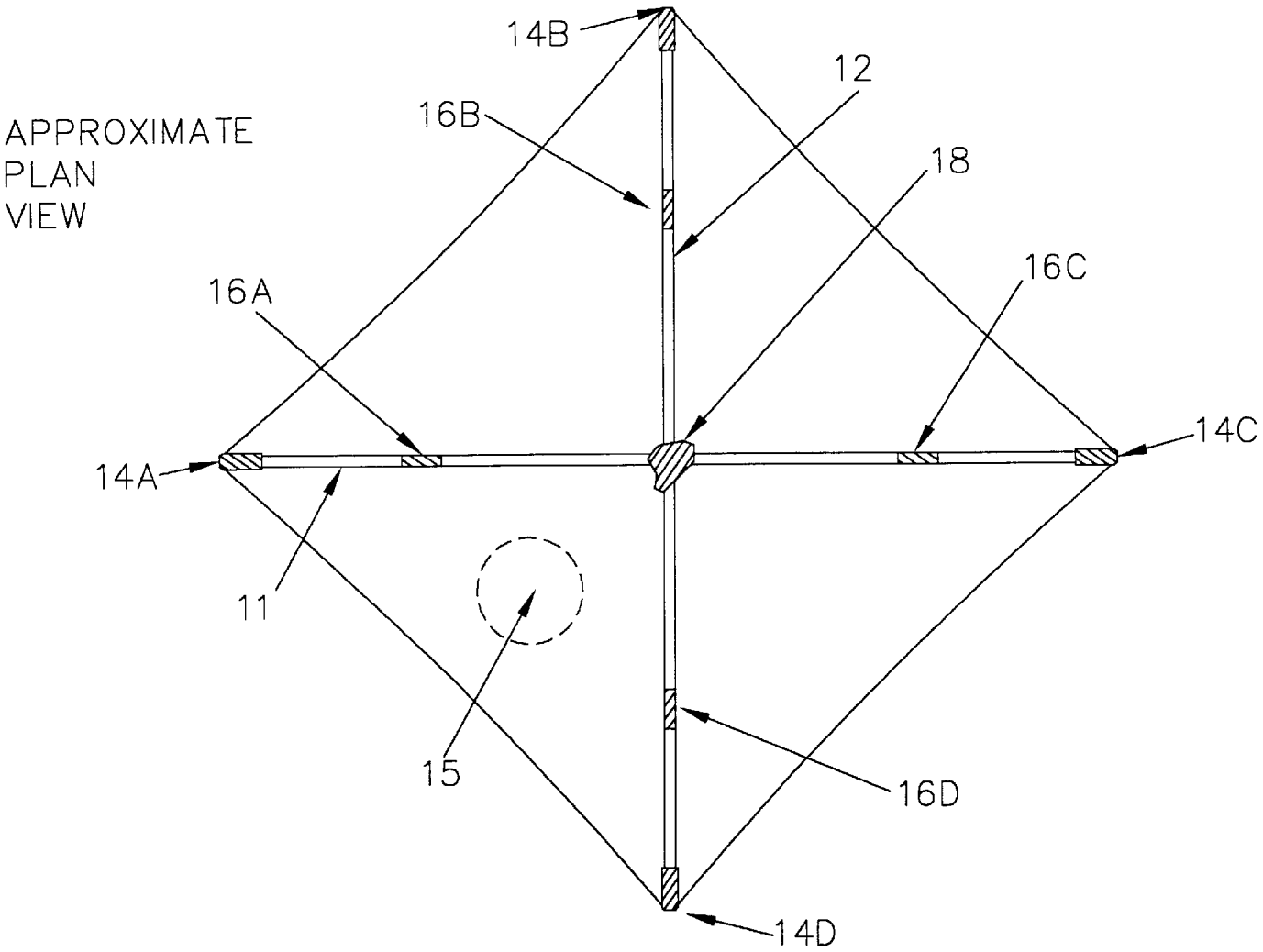
FIG. 10 is a plan view of a tent in the erect position showing the relative approximate position of the four lateral retaining loops and of the apical retaining loop, according to another embodiment of the invention.

FIG. 10 is also a plan view of tent 8 in the erect position showing the relative approximate position of first, second, third, and fourth lateral retaining loops, 16*a–d,* respectively; first, second, third, and fourth basal retaining boots, 14*a–d,* respectively; and apical retaining loop 18.

Figure 11A:
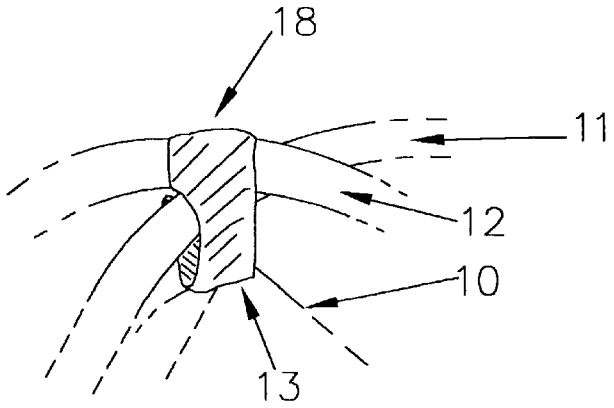
FIGS. 11A–11C show the details of the relationship between the support members and the apical retaining loop, the lateral retaining loops, and the basal retaining boots of a tent in the erect position, according to one embodiment of the invention.

FIG. 11A shows the details of the relationship between the support members 11, 12 and apical retaining loop 18, lateral retaining loops 16*a–d,* and basal retaining boots 14*a–d* of a tent in the erect position. It can be seen from FIG. 11A that apical retaining loop 18 is secured or firmly attached to canopy 10 at or near its apex 13. It can also be seen from FIG. 11A that apical retaining loop 18 comprises a single loop which retains both first and second support members 11, 12 at their point of intersection. At this point, i.e. within apical retaining loop 18, first support member 11 and second support member 12 may be in physical contact. Indeed, at the point of intersection of first and second support members 11 and 12, respectively, the former may partially, to a greater or lesser degree, provide support for the latter.

According to a preferred embodiment of the invention, apical retaining loop 18 may be constructed from a strip of durable material which will resist stretching and having a minimal propensity to tear from shear stresses. The length and width of apical retaining loop 18 is consistent with the overall size and weight of tent 8 and the diameter of support members 11, 12, as well as the particular utility of tent 8. Apical retaining loop 18 may be constructed of a natural or synthetic fiber which is woven, platted, or braided, for example nylon braid or ribbon may be used. Natural or modified polymeric materials such as various forms of silk and spider gossamer threads may be derivatized and/or woven into high tensile threads suitable for preparing fabric for use in construction of apical retaining loop 18. In addition, regarding materials to be used in construction of tent 8 in general, the types of materials currently used in parachute manufacture are expected to be generally applicable to the construction of tent 8 according to at least certain embodiments of the invention. A preferred material for construction of apical retaining loop 18 is cross grain ribbon.

In the case of a relatively small toy or play tent, apical retaining loop 18 may be constructed of a length of nylon braid having a width of from 0.25 inches to about 1.5 inches. For a larger version of tent 8 or where increased strength is desired or required, similar nylon braid of a broader width may be used, or a broader piece of braid could be folded upon itself to provide double, triple, etc., thicknesses of the braid, as appropriate. Alternatively, a different type of material having different physical properties may be used for construction of apical loop 18, as outlined above.

Figure 11B:
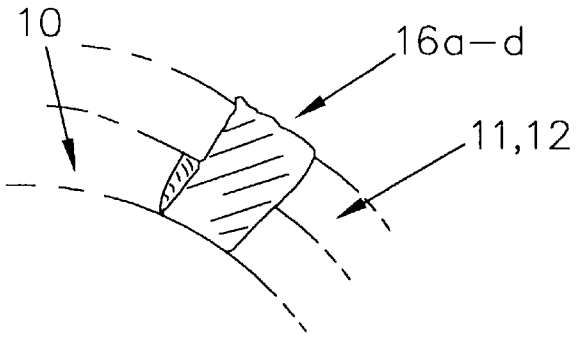

It can be seen from FIG. 11B that a single support member 11 or 12 passes within and is accommodated by each of lateral support loops 16*a–d.* Lateral support loops 16*a–d* are each securely attached to canopy 10 of tent 8 along a corresponding lateral edge 24*a–d.* The distance along each lateral edge 24*a–d* from apex 13 at which lateral support loops 16*a–d* are attached is not absolutely critical to the construction of tent 8 and allows for a certain amount of variation in the construction and resultant overall shape of canopy 10. In a preferred embodiment, however, the distance along each lateral edge 24*a–d* from apex 13 at which lateral support loops 16*a–d* are attached is approximately 50% to 60% of the total length of each lateral edge 24*a–d,* i.e. the distance between apex 13 and each of the four corners of base 9. What has been stated above with respect to possible materials suitable for construction of apical retaining loop 18, also applies equally to materials suitable for construction of lateral retaining loops 16.

Figure 11C:
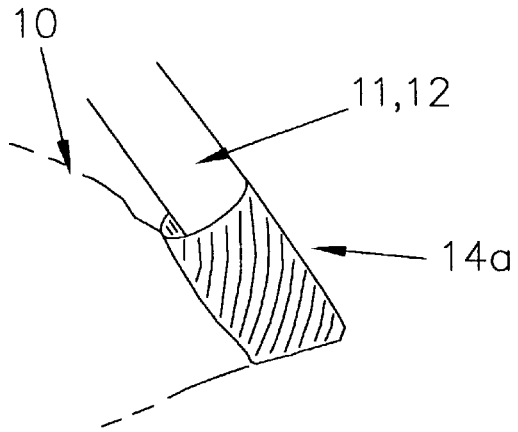

FIG. 11C shows a support member 11, 12 inserted in and retained by one of basal retaining boot 14*a–d,* according to one embodiment of the invention. Basal retaining boot 14*a–d* is secured to the corresponding lateral edge 24*a–d* at a point adjacent to base 9. What has been stated above with respect to possible materials suitable for construction of apical retaining loop 18, also applies equally to materials suitable for construction of basal retaining boots 14.

Figure 11D:
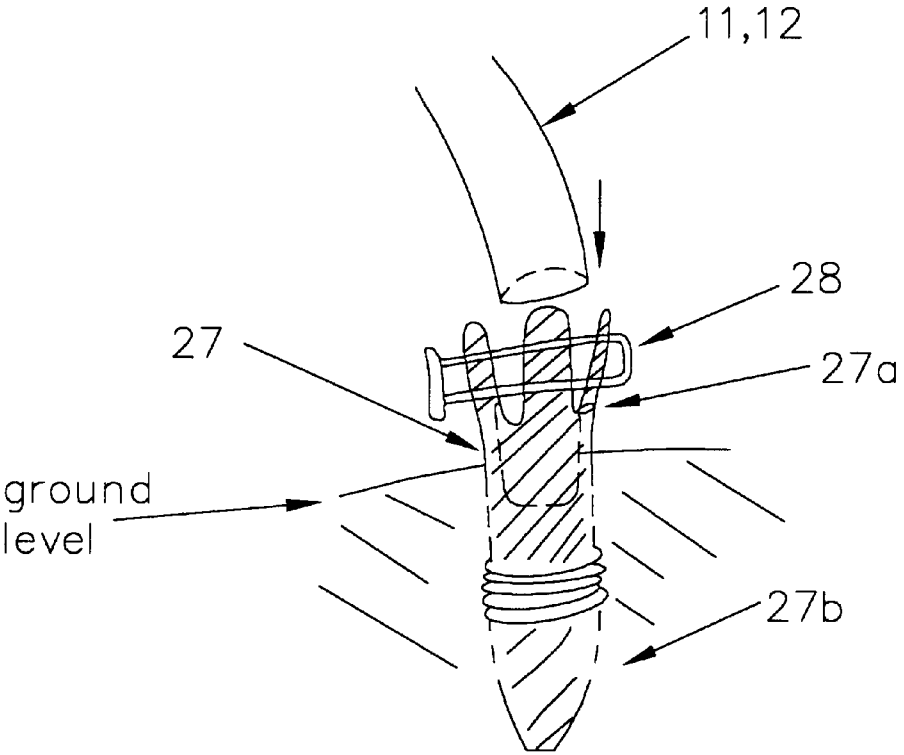
FIG. 11D shows a basal retaining boot which includes a rigid ground-mounted insert for securely holding support members therein, according to anther embodiment of the invention.

According to another embodiment of the invention, shown in FIG. 11D, basal retaining boots 14 may comprise a rigid ground-mounted insert 27 for accommodating support members 11, 12, wherein ground-mounted insert 27 is strengthened by one or more clamps 28 which serve to secure support members 11, 12 within ground-mounted insert 27. Ground-mounted insert 27 is secured to each lateral edge 24*a–d* of canopy 10 adjacent to each corner of base member 9. Ground-mounted insert 27 and clamps 28 may be constructed of various forms of plastics, or of certain forms of metal such as various types of steel.

Ground-mounted insert 27 has a somewhat pointed, mainly solid distal end 27*b* suitable for inserting in the ground at the site where tent 8 is to be pitched. Proximal end 27*a* of ground-mounted insert 27 is generally tubular with fluted walls or has portions cut substantially lengthwise from the walls of proximal end 27*a*, and allows one or more clamps 28 to be clamped around proximal end 27*a* of ground-mounted insert 27 in order to hold support member 11, 12 firmly within insert 27. Clamp(s) 28 may be steel wire clamps similar to those used on certain ski boots, or may be any type of clamp used for firmly attaching tubular structures such as those used for automotive hoses, or any other type of clamp well known in the art.

Ground-mounted insert 27 may include threads or other protuberances to aid in anchoring distal end 27*b* in the ground, e.g. sod, soil, etc. This embodiment of the invention is particularly applicable to embodiments of tent 8 which are relatively large in size and which may be used for sheltering and/or accommodating a plurality of human adults.

Figure 12A:
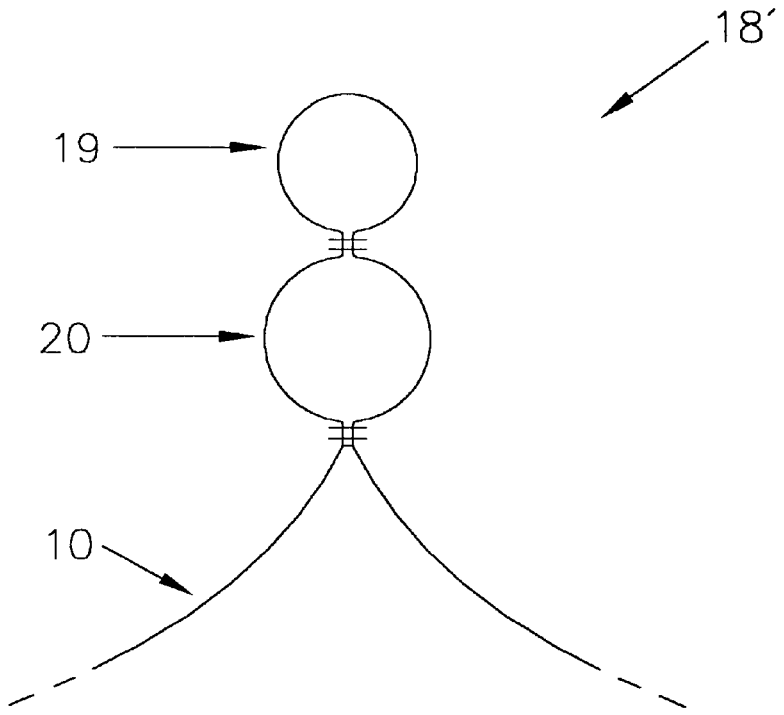
FIG. 12A illustrates a double apical retaining loop with both loops oriented in the same direction, for illustrative purposes only, according to another embodiment of the invention.
Figure 12B:
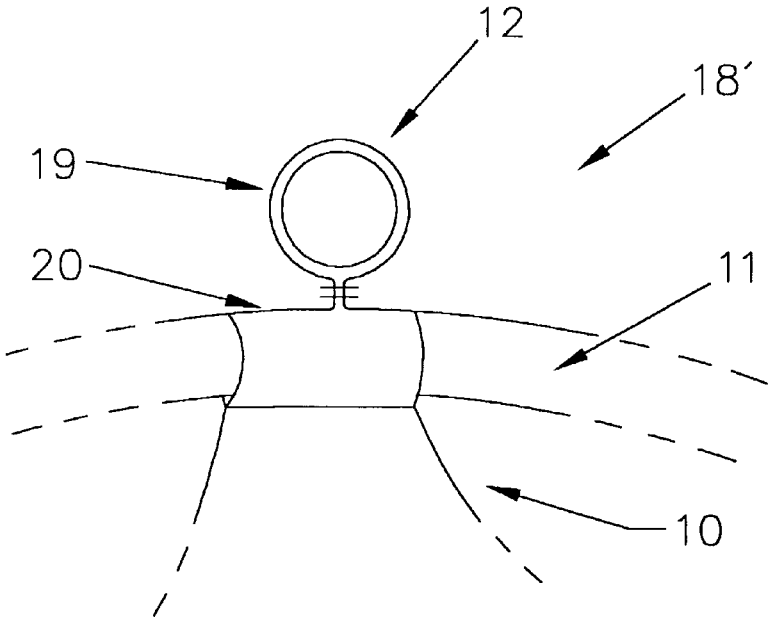
FIG. 12B shows the details of the relationship between the two intersecting support members and a double apical retaining loop of a tent in the erect position, according to the invention.

According to another embodiment of the invention, as shown in FIGS. 12A and 12B, an apical retaining loop 18' may comprise upper and lower apical retaining loops, 19, 20, respectively. Each of upper apical retaining loop 19 and lower apical retaining loop 20 house one support member: either first support member 11, or second support member 12. FIG. 12A illustrates double apical retaining loop 18' with both loops oriented in the same direction, for illustrative purposes only. Each of upper and lower apical retaining loops, 19, 20, respectively, are of substantially equal diameter. FIG. 12B shows the details of the two intersecting support members 11, 12 and double apical retaining loop 18' of a tent in the erect position, and illustrates the relationship between upper and lower retaining loops 19, 20, and first and second support members 11, 12, according to one embodiment of the invention.

One advantage of tent 8 of the instant invention is the simplicity of its components, the speed and ease with which it can be erected and disassembled, and the convenience of storing the disassembled components. In the disassembled state or non-erect position, tent 8 comprises three components as shown in FIGS. 13A, 13B: canopy 10, and first and second support members 11, 12.

Figure 13A:
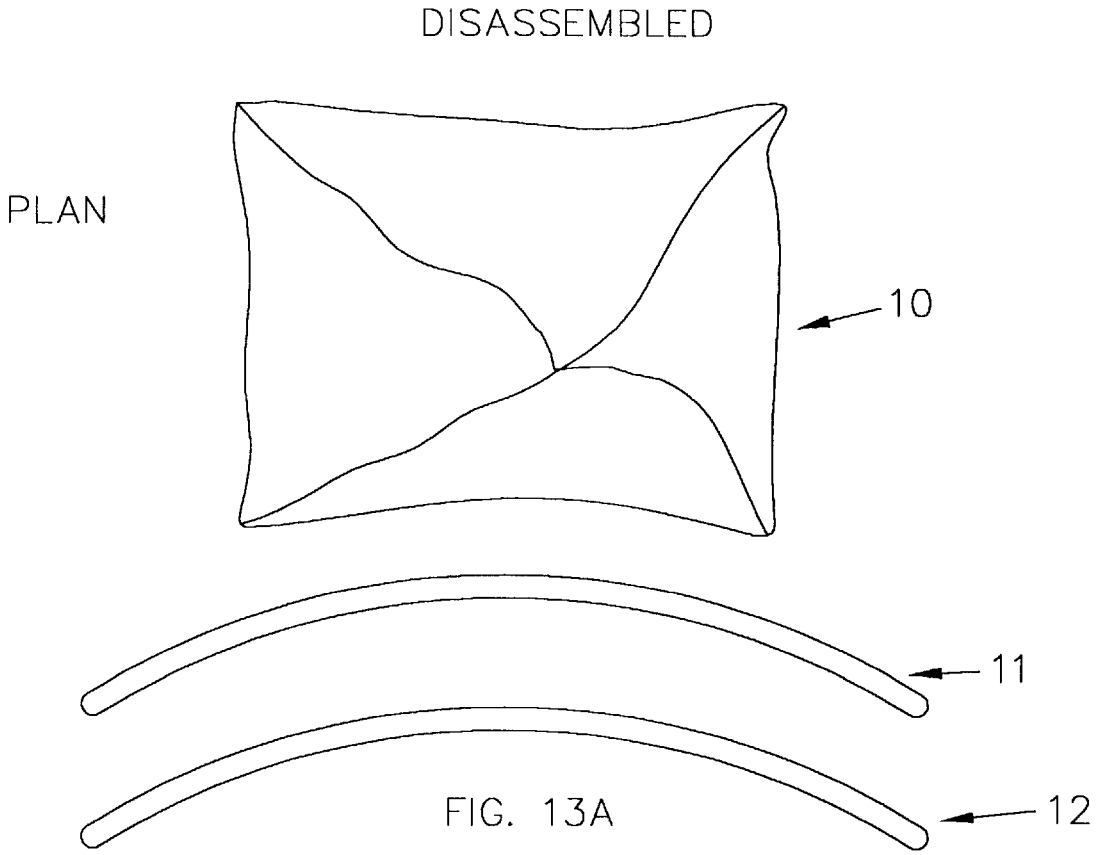
FIGS. 13A and 13B show the canopy and support members of a tent in the disassembled state, in plan view and in sectional view, respectively, according to one embodiment of the invention.

FIG. 13A shows canopy 10 and support members 11, 12 of disassembled tent 8 in plan view. It can be seen that first and second support members 11, 12 may each retain a slight curved configuration after disassembly. This is the situation that can be expected to prevail when support members 11, 12 are constructed of hollow plastic rod such as hollow PVC rod. This slightly curved configuration of support members 11, 12 is of no consequence to storage of one or more tents 8, in that support members 11, 12 can be readily flexed to any desired configuration from substantially straight, to semi-circular, to circular, and may then be clipped in that configuration for storage (FIGS. 14B–D). Moreover, the somewhat curved configuration of support members 11, 12 when tent 8 is disassembled hint at their role in the erect version of the tent and provide for a more intuitive tent erection procedure.

Figure 13B:
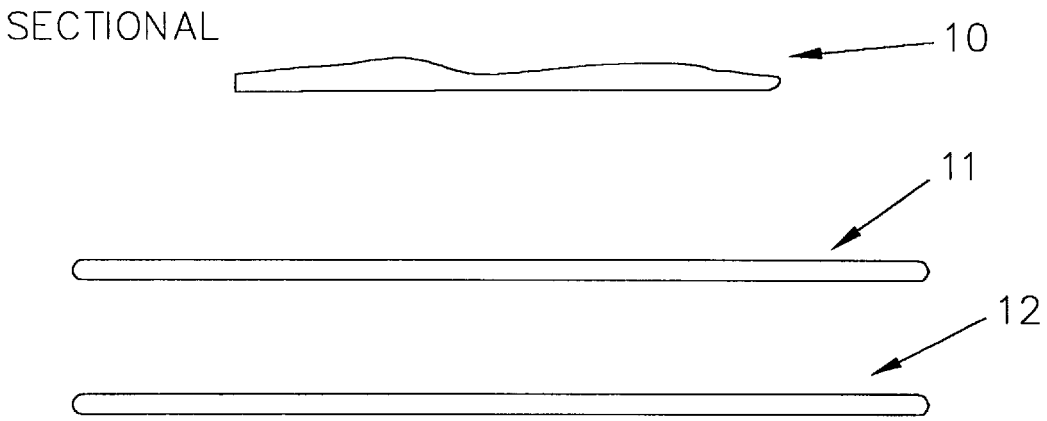

FIG. 13B shows canopy 10 and support members 11, 12 of disassembled tent 8 in sectional view, according to one embodiment of the invention. It can be seen that canopy 10 assumes a more or less flattened shape which can be easily folded for convenient storage.

Figure 14A:
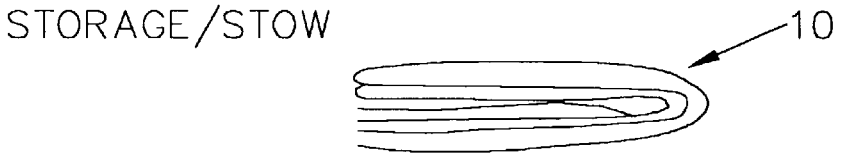
FIG. 14A shows the canopy of a tent folded for storage, according to the invention.
Figure 14B:
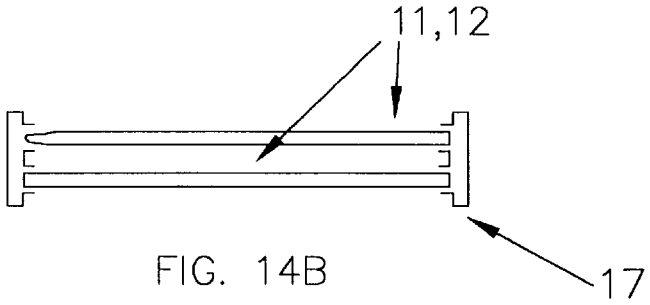
FIGS. 14B–D show the ends of support members of a tent clipped to configure the support members in substantially straight, substantially semi-circular, and substantially circular configuration, respectively, according to one embodiment of the invention.
Figure 14C:
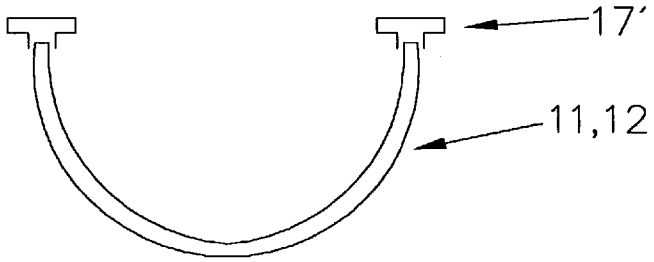
Figure 14D:
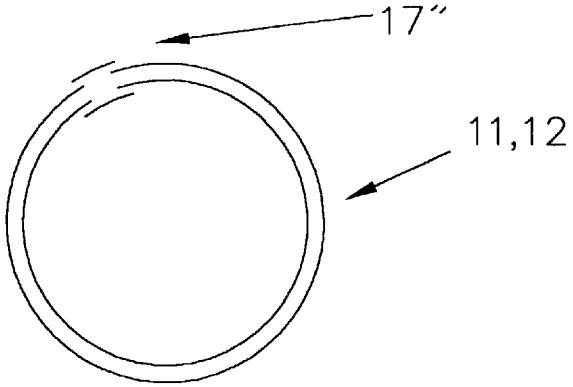

FIG. 14A shows canopy 10 of tent 8 folded for storage. From this folded condition, canopy 10 can be easily unfolded to allow for the rapid assembly or erection of tent 8 as needed.

The features of tent 8 according to the invention which permit rapid erection and deployment of the structure are particularly pertinent and advantageous to a tent 8 of intermediate size, such as one with an overall height of from 3–5 feet, and which may provide shelter for a single person engaged in outdoor activities, such as hiking, hunting, climbing, and the like.

First and second support members 11, 12 when disassembled from tent 8 can be conveniently stored in any of several configurations, for example from substantially straight, to semi-circular, to circular. First and second ends 11*a*, 12*a*, 11*b*, 12*b* of first and second support members 11, 12 may then be clipped by clips 17, 17', 17" in such configurations for storage, as illustrated in FIGS. 14B–D, respectively. When the components of a plurality of tents 8 are to be stored, first and second support members 11, 12 may be stacked adjacent to one another, either in vertical or horizontal orientation, using an appropriate number of clips 17, 17', 17".

Figure 15A:
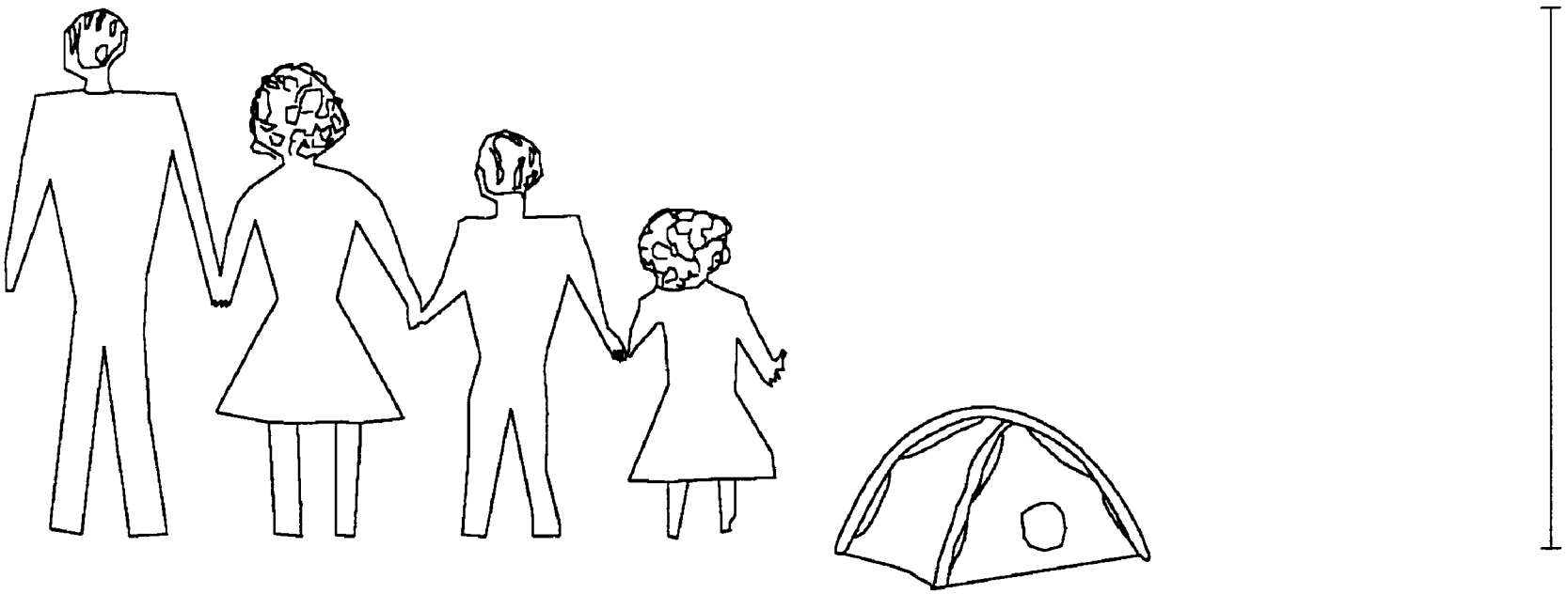
FIGS. 15A–C schematically represent the range in size of a tent to be used as a toy for a small child, to be used as a play tent, and to be used for human shelter, respectively, in relation to the size of adult humans and children, according to three different embodiments of the invention.

As stated above, tent 8 in its various embodiments may be provided in a broad range of different sizes and may be constructed from a broad range of materials, depending on, inter alia, the intended use or function of tent 8 and consumer preferences, etc. In one preferred embodiment, tent 8 is provided in a size range and from materials which make it suitable for use as a toy for a small child. In this regard, the simple and intuitive method of erecting a small version of tent 8 is anticipated to be well within the capability of a young child of average mental capacity in the 3–6 years age group. The approximate size of a toy tent 8 relative to human adults and children is shown in FIG. 15A. A toy tent under the invention may have an overall height ranging from a few inches to about 40 inches, preferably the overall height of a toy tent is from about 6–16 inches. The dimensions of the various components of toy tent 8 must obviously be in approximate proportion to a given overall height within the quoted ranges, according to the disclosure of tent 8 presented herein.

As noted above, tent 8 may include a portal, door, or entry 15 in fourth lateral face 22*d*. Optionally, tent 8 may include one or more additional doors or entries in canopy 10. In the case of a toy tent 8, various small toys may be placed within tent 8 via entry 15. Small toys contemplated as being suitable for placement within toy tent 8 include various small stuffed or filled toy "animals", for example various bean-filled toy animals which comprise the BEANIE BABIES COLLECTION™.

Figure 15B:
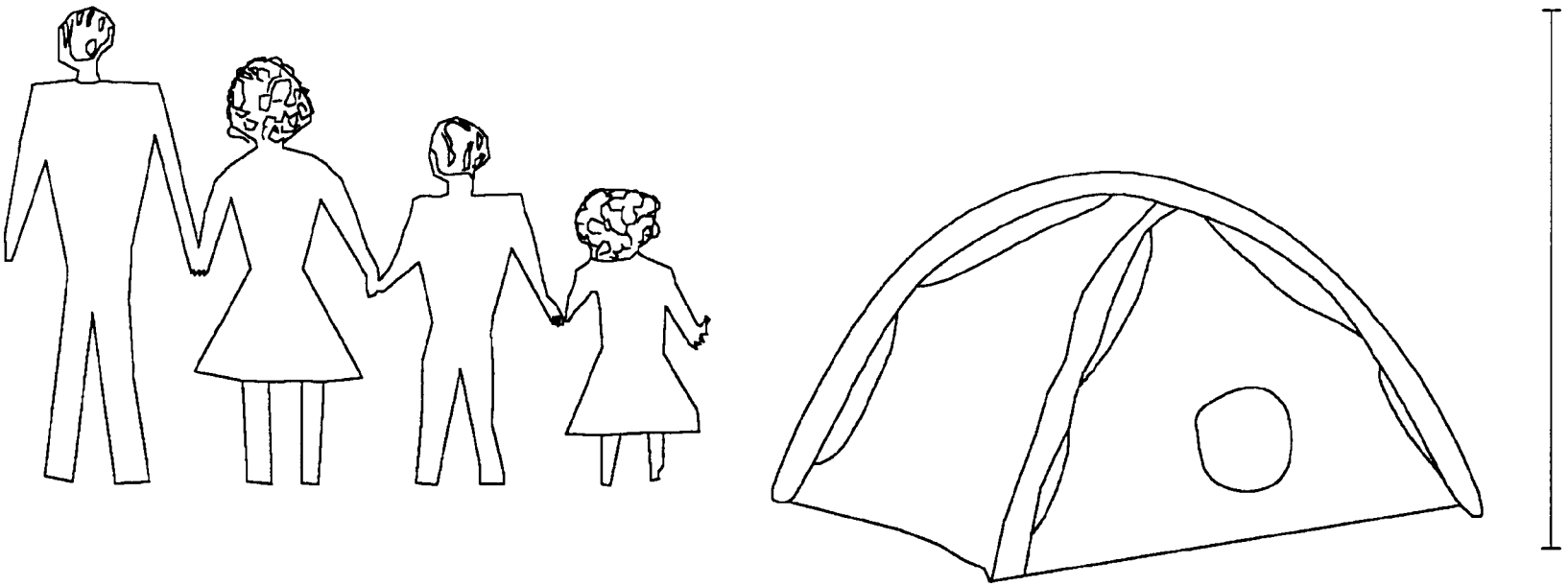

In another embodiment of the invention, tent 8 is provided in a size range and from materials which make it suitable for use as a play tent for one or more children. The approximate size of a toy tent 8 relative to human adults and children is shown in FIG. 15B. A play tent under the invention may have an overall height ranging from about 30 inches to about 60 inches, preferably the overall height of a play tent is from about 3–5 feet. Such a play tent according to the invention is expected to be suitable for children in the 4–10 years old range. The dimensions of the various components of play tent 8 must necessarily be in approximate proportion to any given overall height within the quoted range, according to the disclosure of tent 8 as presented hereinabove.

Figure 15C:
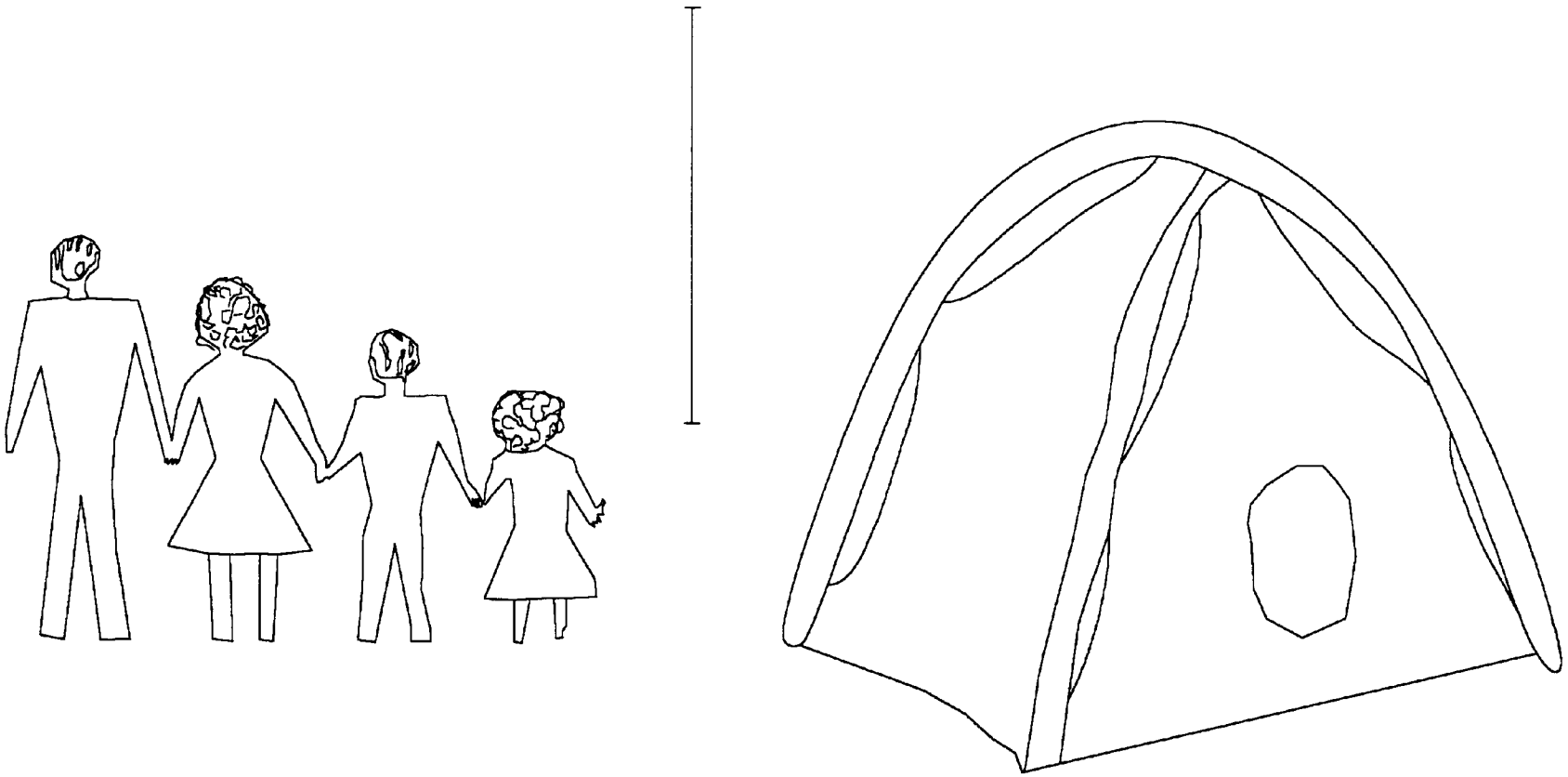

According to yet another embodiment of the invention, tent 8 is provided in a size range and from materials which make it suitable for outdoor use, and being sufficiently weatherproof and spacious so as to provide shelter to at least one person. The approximate size of such a tent 8 relative to human adults and children is shown in FIG. 15C. A tent 8 used as a shelter for outdoor use, according to the invention, may have an overall height ranging from about 36 inches to about 20 feet, preferably the overall height of such a tent is from about 5–8 feet. Once again, the dimensions of the various components of tent 8 must necessarily be in approximate proportion to any given overall height within the quoted range, according to the disclosure of tent 8 as presented hereinabove.

Figure 16A:
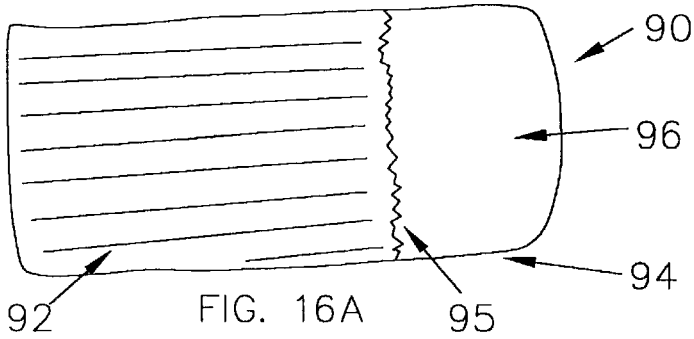
FIGS. 16A–C show a toy sleeping bag (16A) which includes a sleeping bag top (16B) and a sleeping bag bottom (16C), according to one embodiment of the invention.
Figure 16B:
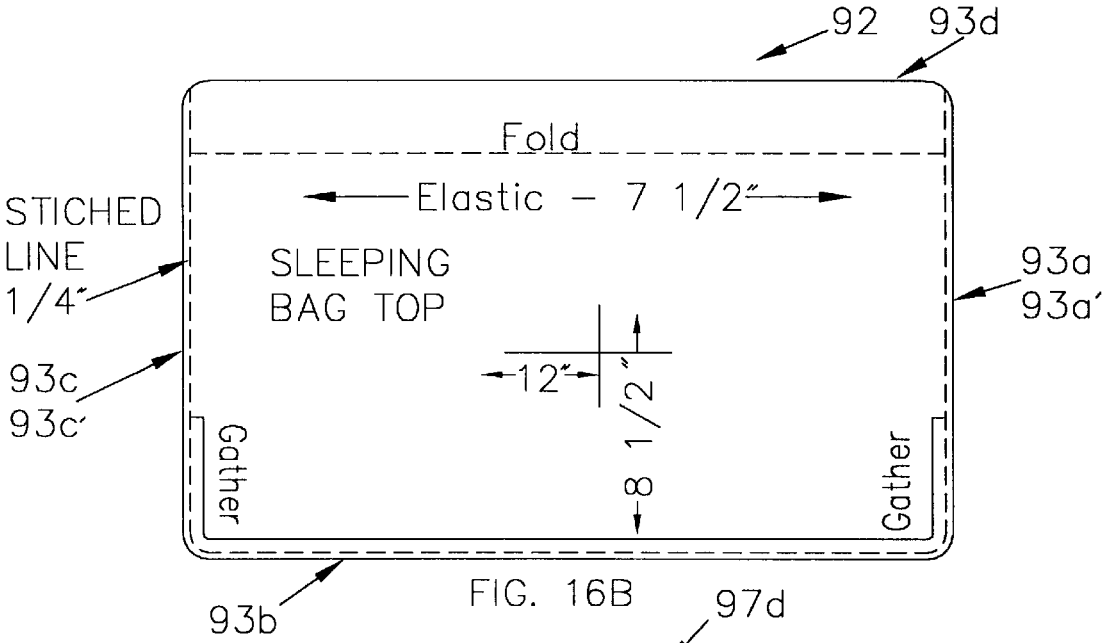
Figure 16C:
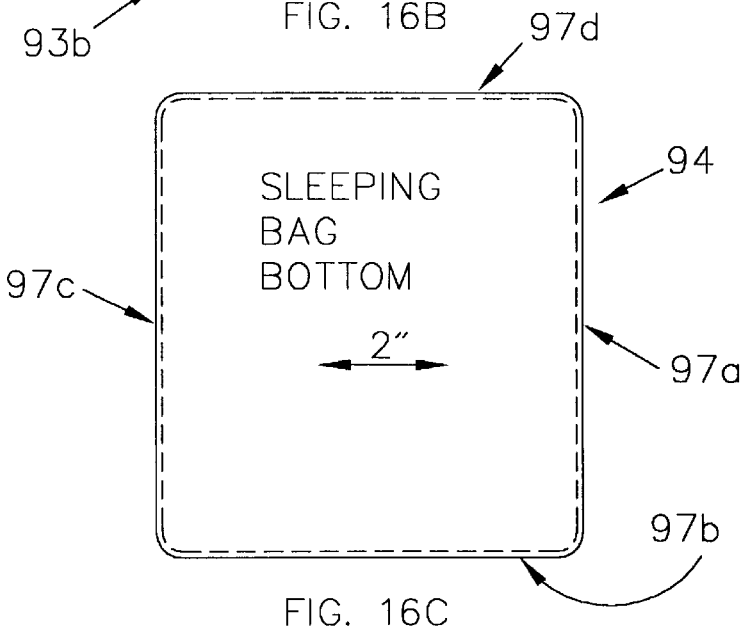

According to one embodiment of the invention, toy tent 8 as disclosed above may include a toy sleeping bag 90 including a sleeping bag top 92 and a sleeping bag bottom 94 as shown in FIGS. 16A–C, wherein toy sleeping bag 90 is intended to be placed within toy tent 8. Sleeping bag bottom 94 is composed substantially of a rectangular piece of fabric including first, second, third, and fourth sides 97*a–d,* respectively. Sleeping bag bottom 94 may be hemmed on one or more of sides 97*a–d,* and sleeping bag bottom 94 includes an open area 96 which allows access to toy sleeping bag 90. Sleeping bag top 92 is composed substantially of a rectangular piece of fabric, which may be hemmed on one or more of first, second, third, and fourth sides 93*a–d.* During assembly of toy sleeping bag 90, fourth side 93*d* is folded to provide a fold line, and a length of elastic may be secured to sleeping bag top 92 at the fold line to provide a folded and elasticated part 95. Folding of sleeping bag top 92 at fourth side 93*d* creates shortened first and second sides 93*a*' and 93*c*', respectively, from first and second sides 93*a* and 93*c* of sleeping bag top 92. The second side 93*b* of toy sleeping bag top 92 may be gathered along all or part of its length at its juncture with toy sleeping bag bottom 94, while shortened first side 93*a*' and third side 93*c*' may each be gathered along a part of their length or partially gathered.

Toy sleeping bag 90, sleeping bag top 92 and sleeping bag bottom 94 shown in FIGS. 16A–C are not drawn to scale. Toy sleeping bag 90 is preferably from about 5–15 inches in length by about 5–15 inches wide; more preferably from about 6–12 inches in length by about 6–12 inches wide, and most preferably about 8 inches in length and about 8 inches wide. Sleeping bag bottom 94 is preferably from about 5–15 inches in length by about 5–14 inches wide; more preferably from about 5–12 inches in length by about 5–11 inches wide, and most preferably about 8 inches in length and about 7 inches wide. Sleeping bag top 92, when in the ungathered and unfolded state prior to assembly of toy sleeping bag 90, is preferably from about 5–15 inches in length by about 8–25 inches wide; more preferably from about 6–12 inches in length by about 6–18 inches wide, and most preferably about 8 inches in length and about 12 inches wide. Sleeping bag top 92, when in the gathered state after assembly of toy sleeping bag 90 with fourth side 93*d* of sleeping bag top 92 folded on itself, is preferably from about 4–14 inches in length by about 5–15 inches wide; more preferably from about 4–10 inches in length by about 5–10 inches wide, and most preferably about 7 inches in length and about 8 inches wide.

Figure 17:
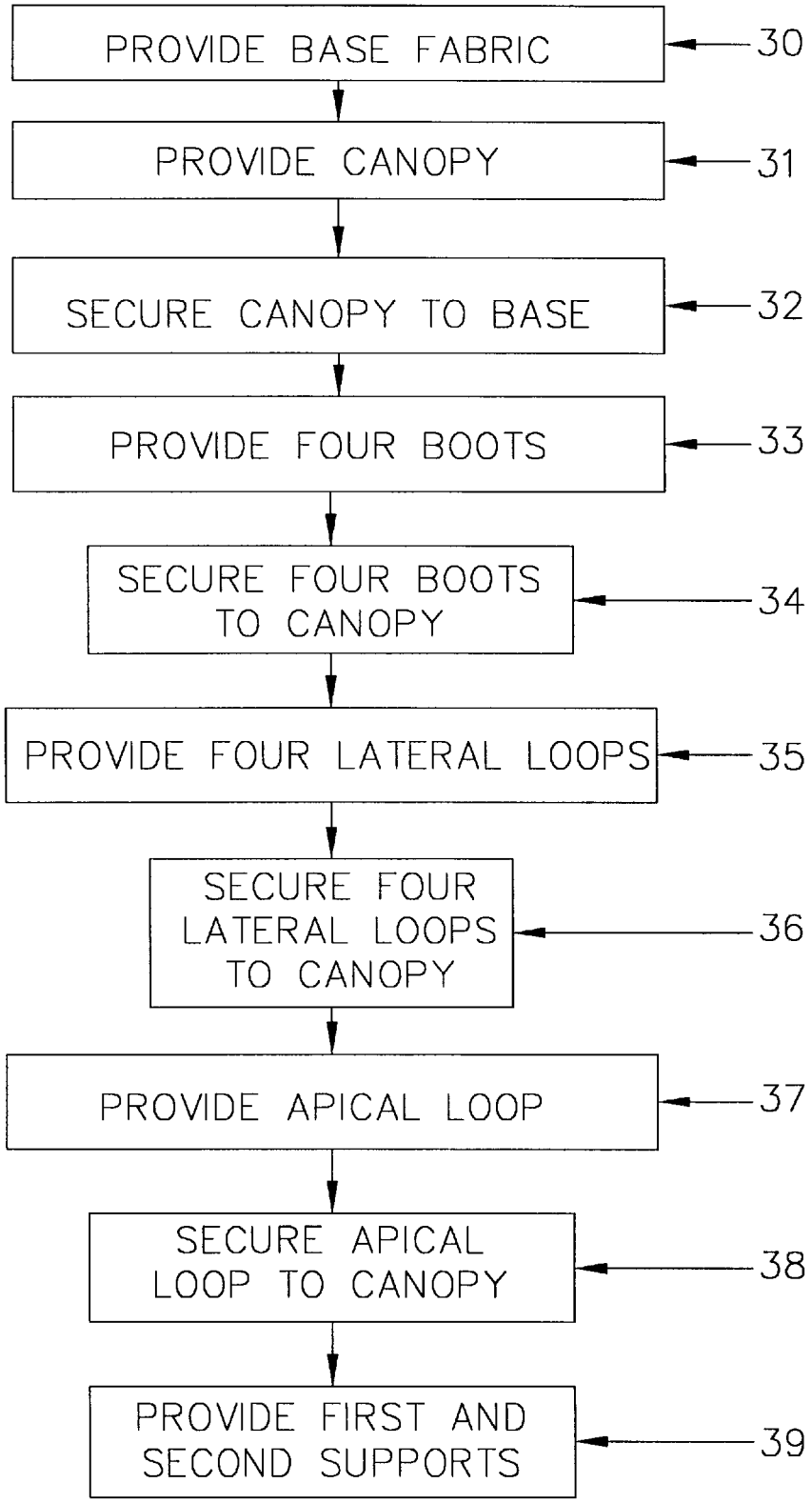
FIG. 17 shows a series of steps involved in a method of making a tent, according to one embodiment of the invention.

FIG. 17 shows a series of steps involved in a method of making a tent-like structure, according to one embodiment of the invention, in which initially step 30 involves providing a base for the tent-like structure. Step 31 then involves providing a canopy for the tent. Step 32 involves securing the canopy to the base, more specifically the basal side of each of the four lateral faces of the canopy are secured to the four corresponding sides or perimeter of the base in order to provide a canopy which is substantially pyramidal in shape when the tent is in the erect position. Step 33 involves providing four basal retaining boots for the tent. Step 34 involves securing each of the four basal retaining boots to the corresponding lateral edge of the canopy, and at a position on each lateral edge adjacent to the base of the tent. Step 35 involves providing four lateral retaining loops. Step 36 involves securing each of the four lateral retaining loops to the corresponding lateral edge of the canopy, and at a position on each lateral edge substantially midway between the base and the apex of the canopy. Step 37 involves providing an apical retaining loop. Step 38 involves securing the apical retaining loop to the canopy at the apex of the canopy. Step 39 involves providing first and second supports. First and second supports are provided as continuous lengths of flexible rod and may be of equal length or of substantially equal length.

Figure 18A:
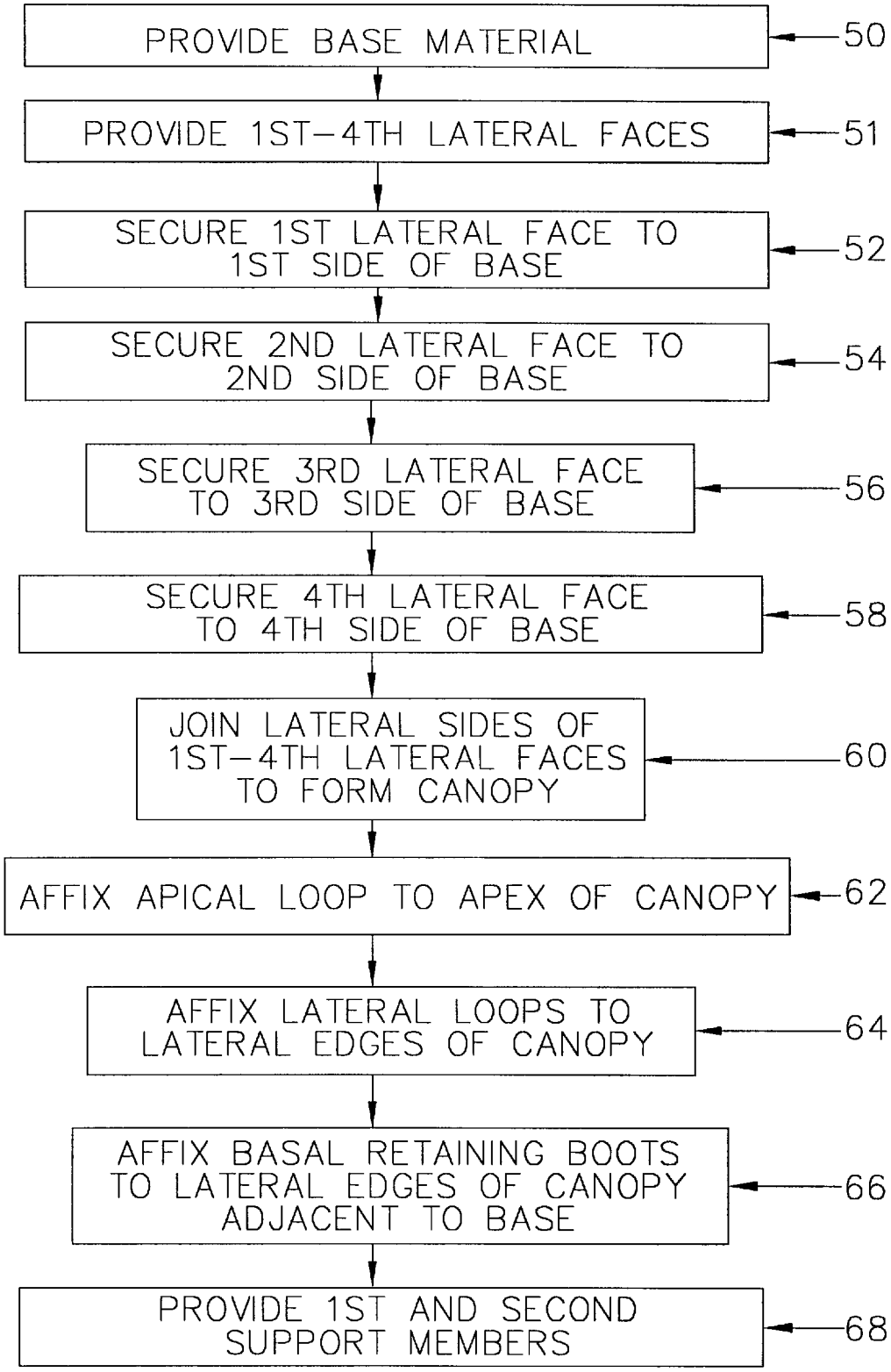
FIG. 18A outlines a series of steps involved in a method of making a tent, according to another embodiment of the invention.
Figure 18B:
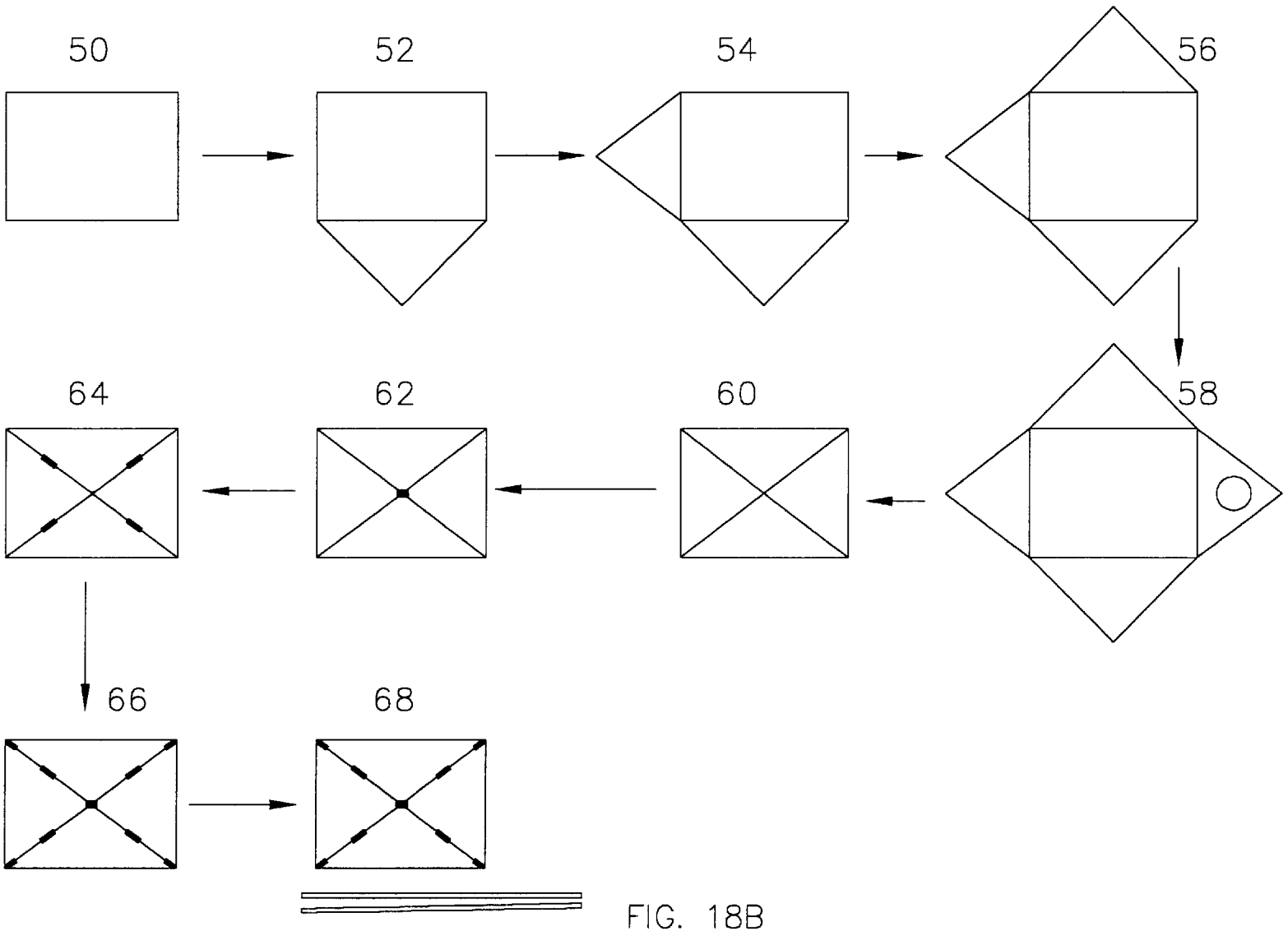
FIG. 18B graphically indicates the stages in a method of making a tent, according to the method steps outlined in FIG. 18A.

FIG. 18A outlines a series of steps involved in a method of making a tent, according to another embodiment of the invention, in which step 50 involves providing a base or base member of suitable material or fabric. Step 51 then involves providing first, second, third, and fourth lateral faces of the tent canopy. Step 52 involves securing the first lateral face to a first side of the base. Step 54 involves securing the second lateral face to the second side of the base. Step 56 involves securing the third lateral face to the third side of the base. Step 58 involves securing the fourth lateral face to the fourth side of the base. Step 60 involves joining the lateral sides of first, second, third, and fourth lateral faces to form the canopy of the tent. Step 62 involves affixing an apical retaining loop to the apex of the canopy. Step 64 involves affixing first, second, third, and fourth lateral retaining loops to the respective first, second, third, and fourth lateral edges of the canopy. Step 66 involves affixing first, second, third, and fourth basal retaining boots to the respective first, second, third, and fourth lateral edges of the canopy adjacent to the base. Step 68 involves providing first and second support members. FIG. 18B graphically indicates the stages in a method of making a tent, according to the method steps outlined above and which are schematically represented in FIG. 18A.

Figure 19:
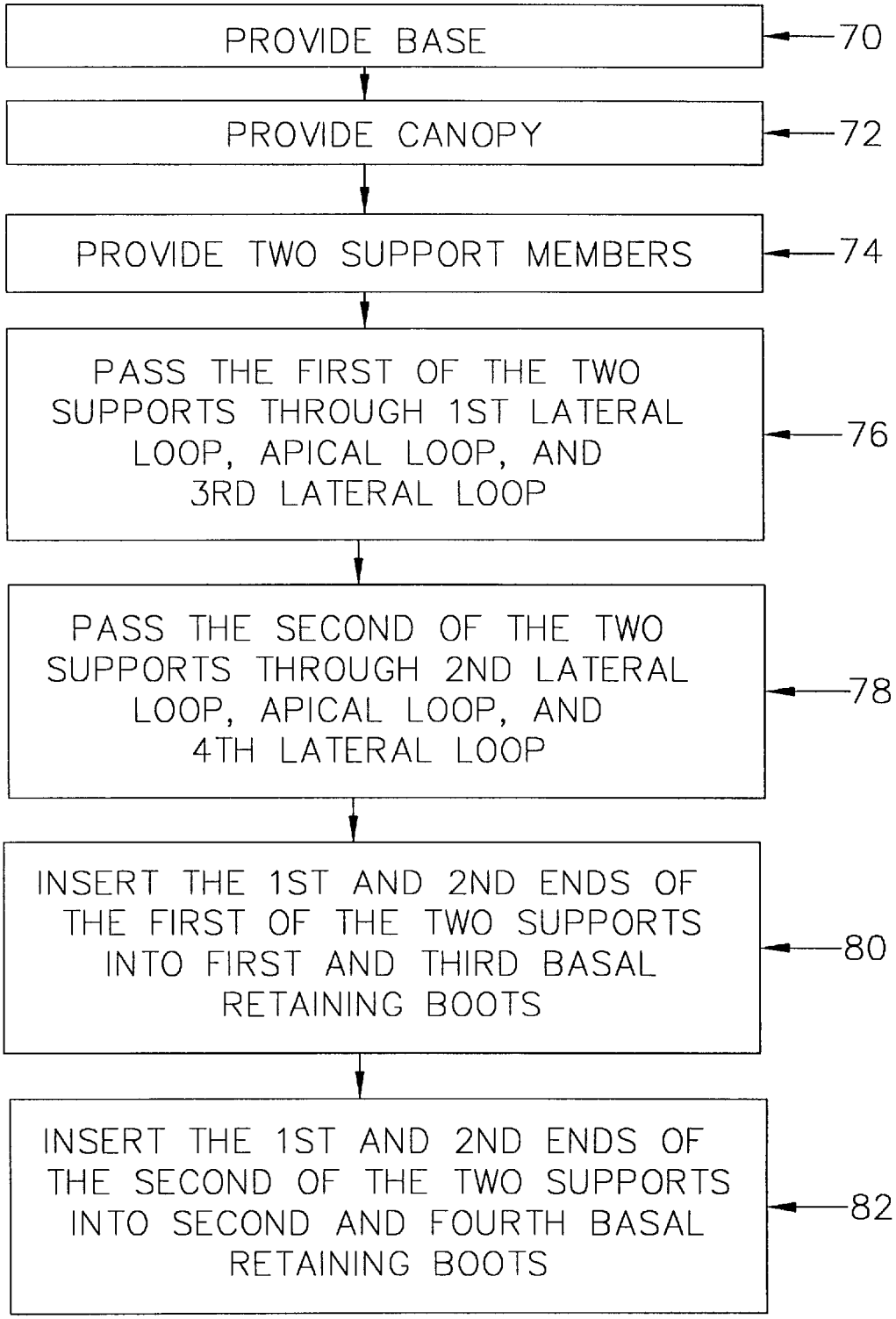
FIG. 19 shows a series of steps involved in a method of erecting a tent, according to one embodiment of the invention.

FIG. 19 schematically represents a series of steps involved in a method of erecting a tent, according to one embodiment of the invention. Thus, step 70 involves providing a base or base member. Step 72 involves providing a canopy of the tent. Step 74 involves providing two support members for the tent. Step 76 involves passing the first of the two supports through a first lateral retaining loop, an apical loop, and a third lateral retaining loop. Step 78 involves passing the second of the two supports through a second lateral retaining loop, the apical loop, and a fourth lateral retaining loop. Step 80 involves inserting the first and second ends of the first of the two supports into a first retaining boot and into a third basal retaining boot. Step 82 involves inserting the first and second ends of the second of the two supports into a second retaining boot and into a fourth basal retaining boot.

The ratio of the dimensions of various components of tent 8 to each other may not be critical, although, as mentioned hereinabove restriction within certain ranges for the ratio of the dimensions of various components is inherent in the invention. The degree of latitude conferred on the ranges of the ratios of particular components to other components is governed, among other things, by the particular materials from which the respective components are constructed. Therefore, the ranges for the ratios of the dimensions of the various components is restricted only by the limitations of the tent-like structure as disclosed herein. Nevertheless, according to preferred embodiments of the invention, preferred ratios for the various components are cited as follows. Preferably the ratio of the length of each of the first and second support members to the length of each of the four sides of the base is about 1.5:1 to about 3.0:1, and more preferably from about 1.5:1 to about 2.0:1, and most preferably from about 1.8:1 to about 2.0:1. Preferably the ratio of the length of each of the first and second support members to the external diameter of each of the first and second support members is from about 50:1 to about 120:1, more preferably from about 70:1 to about 100:1, and most preferably from about 80:1 to about 95:1. Preferably the ratio of the length of each of the first and second support members to the internal diameter of each of the first and second support members is from about 100:1 to about 240:1. Preferably the ratio of the length of each of the first and second support members to the vertical distance of the apex of the canopy from the base ranges from about 2.5:1 to about 5:1, more preferably from about 3:1 to about 4:1, and most preferably about 3.5:1.

Figure 20:
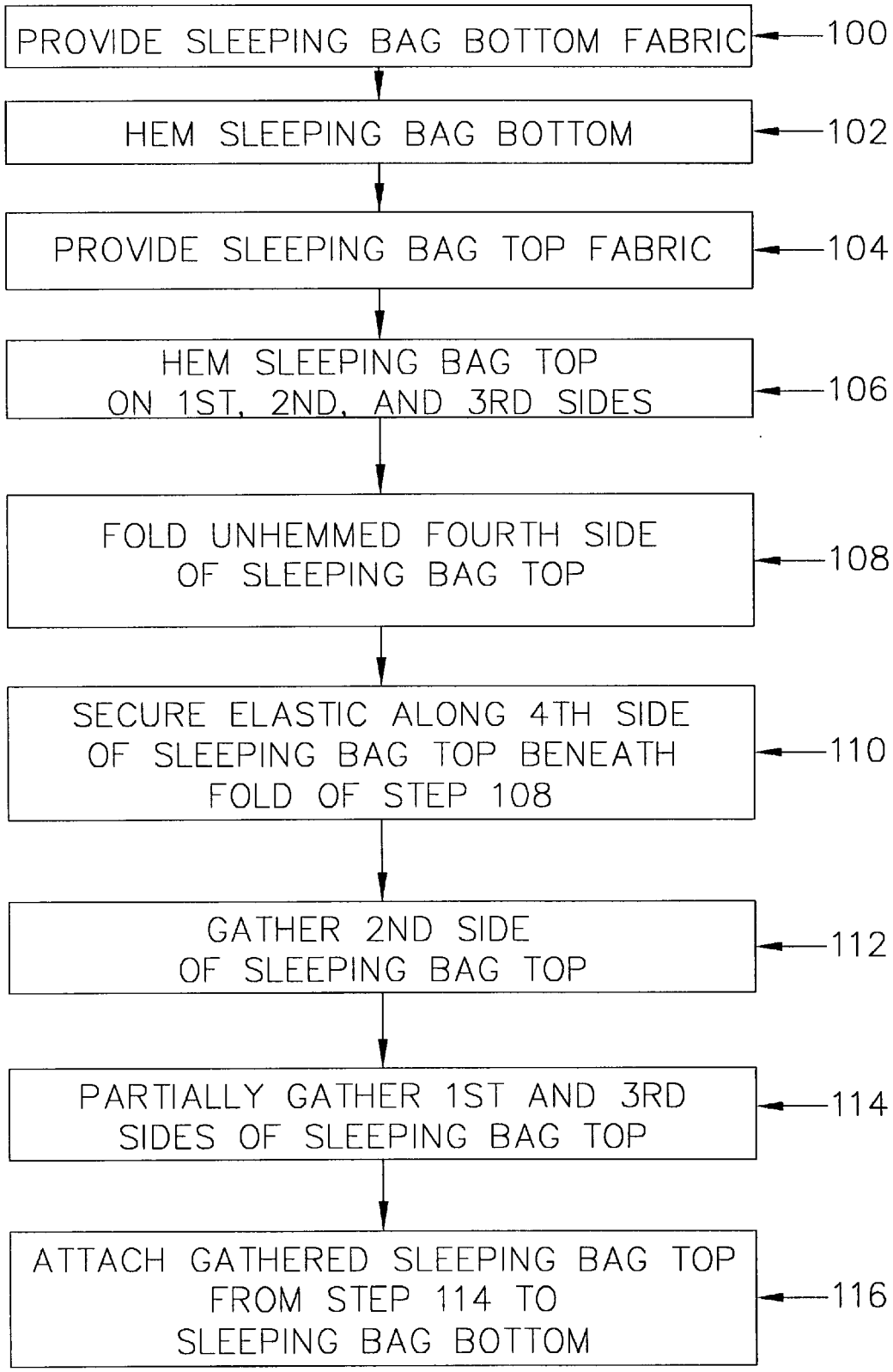
FIG. 20 schematically represents a series of steps involved in a method of making a toy sleeping bag, according to one embodiment of the invention.

FIG. 20 schematically represents a series of steps involved in a method of making a toy sleeping bag, according to one embodiment of the invention, in which step 100 involves providing a sleeping bag bottom. Then step 102 involves hemming at least one side of the sleeping bag bottom. Step 104 involves providing a sleeping bag top. Step 106 involves hemming first, second, and third sides of the sleeping bag top. Step 108 then involves folding fourth side of the sleeping bag top to provide a fold along the fourth side of the sleeping bag top. Step 108 results in a sleeping bag top whose length is equal to or less than the length of the sleeping bag bottom. Step 110 then involves securing elastic along the fourth side of the sleeping bag top beneath the fold provided in step 108. Step 112 involves gathering the second side of the sleeping bag top. Step 114 involves gathering the first side and the third side of the sleeping bag top along at least part of their respective length. Finally, step 116 involves attaching the gathered sleeping bag top provided in step 114 to the sleeping bag bottom by joining the first, second, and third sides of the sleeping bag top to the respective first, second, and third sides of the sleeping bag bottom. In situations where the length of the sleeping bag top is less than the length of the sleeping bag bottom, part of each of the first and third sides of the sleeping bag bottom are free or unattached to the sleeping bag top after step 116 has been performed, thereby providing an open area of the sleeping bag bottom.

Figure 21:
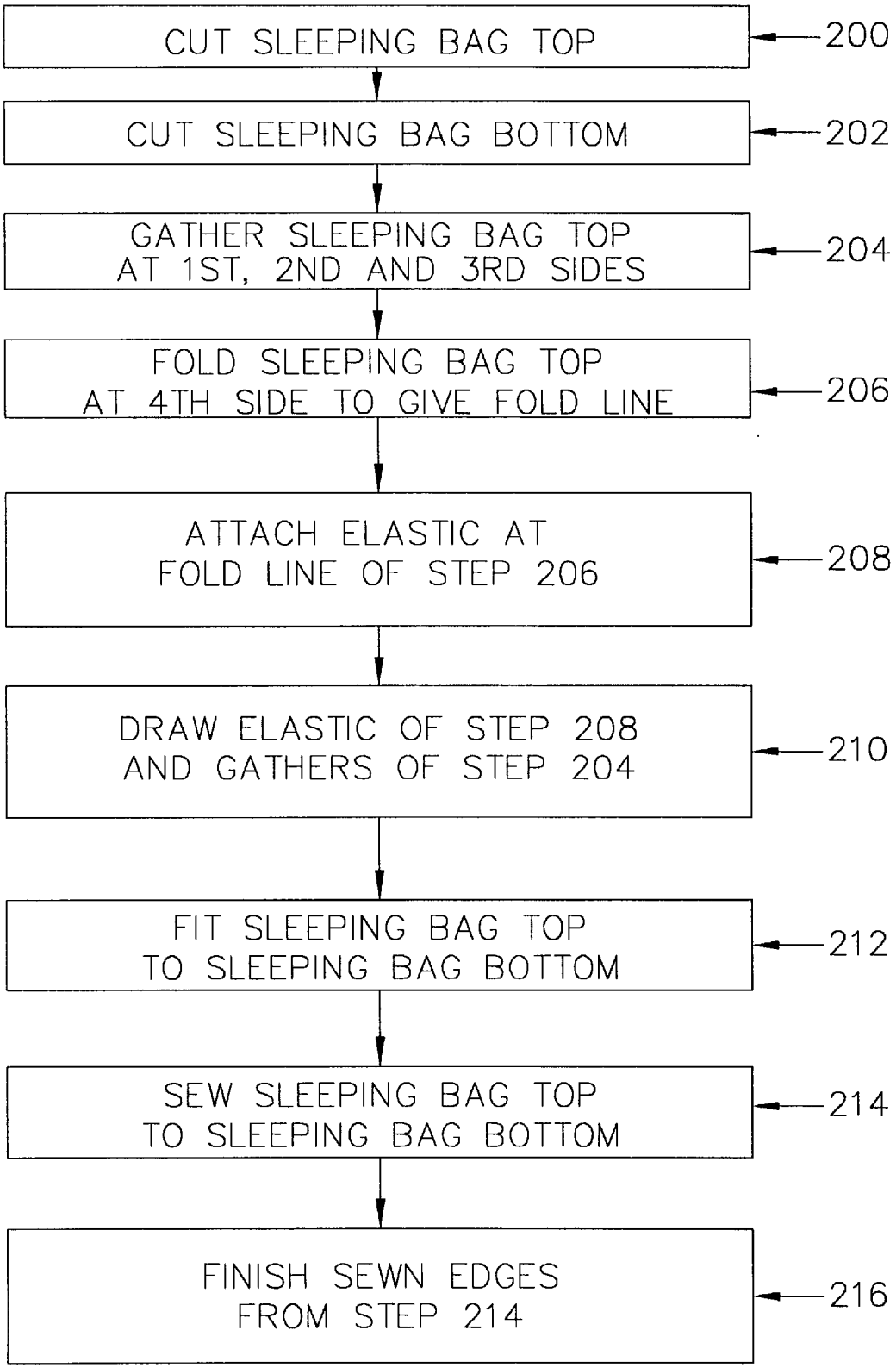
FIG. 21 schematically represents a series of steps involved in a method of making a toy sleeping bag, according to another embodiment of the invention.

FIG. 21 schematically represents a series of steps involved in a method of making a toy sleeping bag, according to another embodiment of the invention, in which step 200 involves providing a sleeping bag top. Then step 202 involves providing a sleeping bag bottom. Step 204 involves gathering the sleeping bag top along at least part of the respective lengths of its first, second, and third sides, 93*a–c* respectively. Step 206 involves folding the sleeping bag top along its fourth side 93*d* to provide a fold line substantially parallel to fourth side 93*d*. At the same time, step 206 provides shortened first and third sides 93*a*' and 93*c*', respectively. Step 208 involves attaching a length of elastic at or along the fold line resulting from step 206. Step 208 may involve attaching a length of elastic along the entire length of the fold line or along at least a portion of the entire length of the fold line resulting from step 206. Step 210 involves drawing or gathering the elastic attached to the sleeping bag top in step 208, and drawing or gathering the gathers provided in step 204, such that the sleeping bag top has the same width or substantially the same width as the sleeping bag bottom provided in step 202. Step 212 then involves fitting the sleeping bag top to the sleeping bag bottom, such that sleeping bag top second side 93*b* is flush or aligned with sleeping bag bottom second side 97*b*; and such that shortened first and third sides 93*a*', 93*c*' of sleeping bag top 92 are aligned with first and third sides 97*a*, 97*c* of sleeping bag bottom 94. Step 214 involves sewing sleeping bag top 92 to sleeping bag bottom 94. Step 216 involves applying a finish to the sewn edges or sides of the sleeping bag. For example, step 216 may include encasing the sewn areas of the sides of the sleeping bag in bias tape (e.g. Wrights Extra Wide Double Fold Bias Tape).

Figure 22:
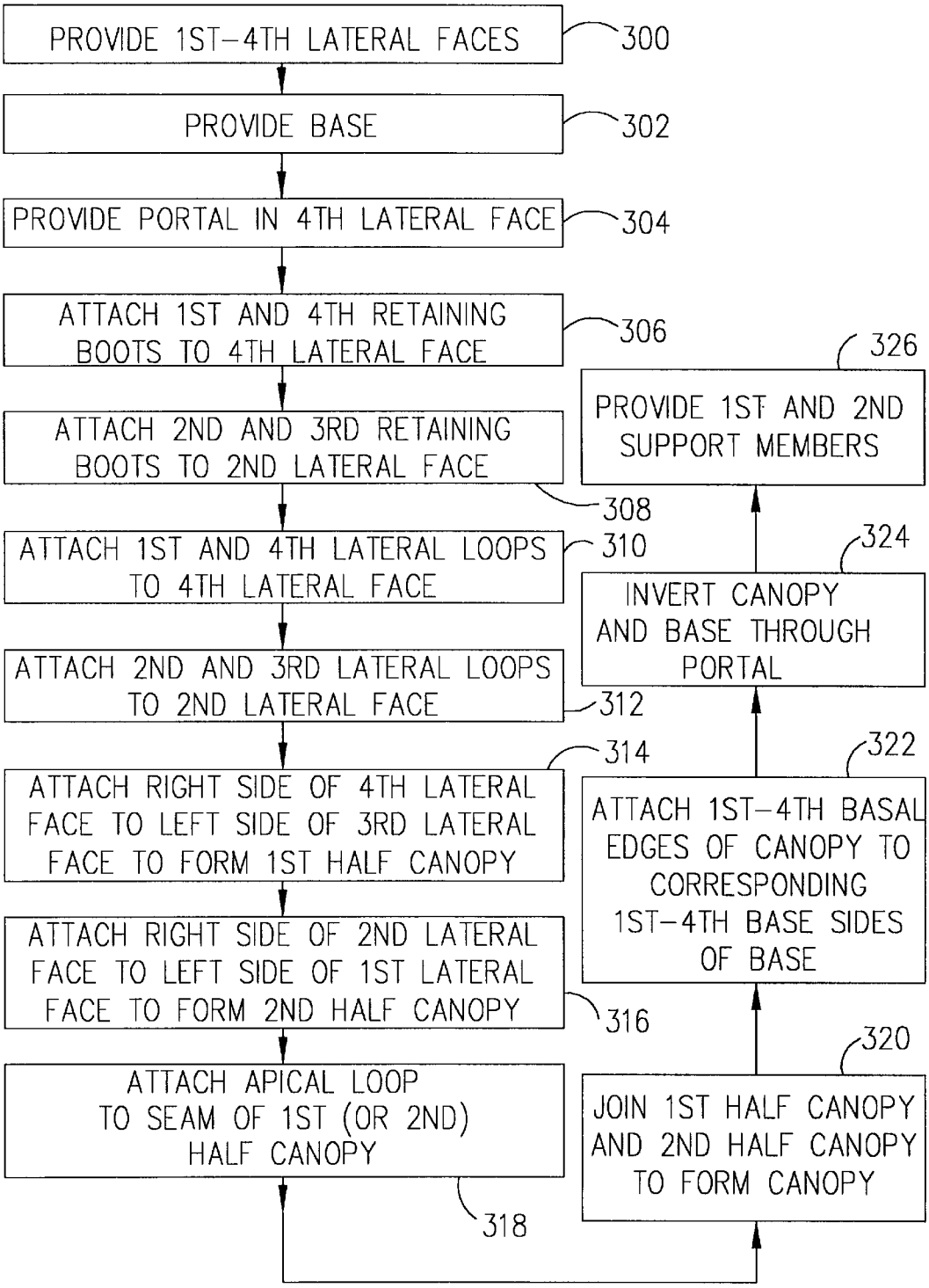
FIG. 22 schematically represents a series of steps involved in a method for providing a tent in the disassembled state, according to another embodiment of the invention.

FIG. 22 schematically represents a series of steps involved in a method for providing a tent in the disassembled state, in which step 300 involves providing first, second, third, and fourth lateral faces of a tent canopy. Step 302 involves providing a base of the tent, the base having first, second, third, and fourth sides of substantially equal length. Step 304 involves providing a portal in the fourth lateral face. The portal or entry may be more or less circular, oval, rectangular, etc. in shape. The edge or perimeter of the portal may be finished by attaching a length of tape, ribbon, or rick rack to the portal perimeter, for example, a length of Wrights Jumbo Rick Rack may be used. Step 306 involves attaching first and fourth basal retaining boots to the fourth lateral face. Step 308 involves attaching second and third basal retaining boots to the second lateral face. Step 310 involves attaching first and fourth lateral retaining loops to the fourth lateral face. Step 312 involves attaching second and third lateral retaining loops to the second lateral face. Step 314 involves attaching the right side of fourth lateral face to the left side of the third lateral face to form a first half canopy of the tent canopy. Step 316 involves attaching the right side of the second lateral face to the left side of the first lateral face to form a second half canopy of the tent canopy. Step 318 involves attaching an apical retaining loop to a nascent apex of the tent canopy of the first or second half canopy. By nascent apex is meant that part of the first or second half canopy which will form the apex of the tent canopy when the tent is assembled. The nascent apex of the tent canopy lies along the seam where two lateral faces of the canopy are joined. Step 320 involves joining the first half canopy to the second half canopy to form a tent canopy having first, second, third, and fourth basal edges. Step 322 involves attaching each of the first, second, third, and fourth basal edges of the tent canopy to a corresponding first, second, third, and fourth side of the base to form a combined tent base and canopy. Step 324 involves inverting the combined tent base and canopy through the portal. Finally, step 326 involves providing first and second support members for supporting the tent canopy.

While the tent-like structure has been described herein primarily with respect to a toy tent, a play tent, and a tent for human shelter, it is to be understood that certain embodiments of the instant invention may also be applicable to other uses including, for example, the storage of various objects and goods, as well as shelter for pets or other domesticated animals.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A tent-like structure, comprising:

a base having four sides of substantially equal length and four corners;

a canopy having a substantially pyramidal shape, said canopy having four lateral edges, four basal edges, and an apex;

an apical retaining loop secured to said canopy at substantially said apex of said canopy, the apical retaining loop including an upper apical retaining loop and a lower apical retaining loop;

four lateral retaining loops, one of said four lateral retaining loops secured to each of said four lateral edges of said canopy, and said four lateral retaining loops spaced equidistant from said apex of said canopy;

four basal retaining boots, one of said four basal retaining boots secured to each of said four lateral edges at a location on each of said four lateral edges adjacent to each of said four corners of said base; and first and second support members each comprising a continuous flexible rod, each of said first and second support members passing within and retained by respective ones of the upper and lower apical retaining loops, each of said first and second support members passing within and retained by two of said lateral retaining loops, and each end of each of said first and second support members inserted into and retained by one of said four basal retaining boots, wherein said first and second support members each form an arc, said arc concave with respect to said base, and said first and second support members intersect at a point substantially immediately above said apex.

2. The structure as claimed in claim 1, wherein said first and second support members each comprise a continuous flexible hollow rod.

3. The structure as claimed in claim 1, wherein said apex is separated from said base by a vertical distance ranging from 6 inches to 20 feet.

4. The structure as claimed in claim 1, wherein each of said first and second support members has a length ranging from 20 inches to 70 feet, and a diameter ranging from 0.2 inches to 15 inches.

5. The structure as claimed in claim 1, wherein each of said four sides of said base has a length in the range of from about 10 inches to about 40 feet, and the ratio of the length of each of said first and second support members to the length of each of said four sides of said base is about 1.5:1 to about 3.0:1.

6. The structure as claimed in claim 1, wherein the ratio of the length of each of said first and second support members to the external diameter of each of said first and second support members is from about 50:1 to about 120:1.

7. The structure as claimed in claim 1, wherein the ratio of the length of each of said first and second support members to the external diameter of each of said first and second support members is from about 70:1 to about 100:1.

8. The structure as claimed in claim 1, wherein each of said first and second support members comprises a hollow rod, and the ratio of the length of each of said first and second support members to the internal diameter of each of said first and second support members is from about 100:1 to about 240:1.

9. The structure as claimed in claim 1, wherein the ratio of the length of each of said first and second support members to the vertical distance of said apex of said canopy from said base ranges from about 2.5:1 to about 5:1.

10. The structure as claimed in claim 1, wherein the ratio of the length of each of said first and second support members to the vertical distance of said apex of said canopy from said base ranges from about 3:1 to about 4:1.

11. The structure as claimed in claim 1, wherein the ratio of the length of each of said first and second support members to the vertical distance of said apex of said canopy from said base is about 3.5:1.

12. The structure as claimed in claim 1, wherein each of said first and second support members is bent into a substantially semi-circular configuration, and said first and second support members intersect each other at a point substantially immediately above said apex of said canopy, and said first and second support members are in physical contact at the point of intersection.

13. The structure as claimed in claim 1, wherein said four lateral retaining loops are located at a distance of approximately 50%–60% of the total length of said four lateral edges from said apex of said canopy.

14. The structure as claimed in claim 1, wherein each of the four basal retaining boots comprise a cup-like enclosure for holding an end of one of the first and second support members.

15. The structure as claimed in claim 1, wherein each of the four basal retaining boots comprise a ground mountable insert that includes a grounding portion configured to be inserted in a ground and a cup-like receiving portion configured to surround and hold an end of one of the first and second support members.

16. The structure as claimed in claim 15, wherein the cup-like receiving portion of each of the four basal retaining boots comprises at least one clamp for fixing the cup-like receiving portion to an end of one of the first and second support members.

17. An easily erected structure, comprising:

a base member having four sides forming a perimeter of the base, said base member having first, second, third, and fourth corners;

a canopy having an apex, and first, second, third and fourth lateral edges, and said canopy further having four lateral faces, each of said four lateral faces having a basal side and two lateral sides, said two lateral sides of approximately equal length, each of said four lateral faces connected together along their respective lateral sides, and said four lateral faces connected together forming a substantially pyramidal shaped canopy, and said basal side of each of said four lateral faces of said canopy secured to said base member along the perimeter of the base member;

first, second, third and fourth retaining boots secured to said first, second, third and fourth lateral edges, respectively, at a position adjacent to said first, second, third, and fourth corners of said base, respectively;

an apical retaining loop secured to said canopy substantially at said apex, the apical retaining loop including an upper loop and a lower loop; and first and second smooth walled flexible supports each passing through respective ones of the upper and lower apical retaining loops and each end of said first and second flexible supports inserted into and retained by one of said first, second, third, and fourth retaining boots.

18. The easily erected structure as claimed in claim 17, wherein each of said first and second flexible supports comprises a continuous flexible rod, and each of said first and second flexible supports assumes approximately a semi-circular configuration when the structure is erected.

19. The structure as claimed in claim 17, wherein each of the four basal retaining boots comprise a cup-like enclosure for holding an end of one of the first and second support members.

20. The structure as claimed in claim 17, wherein each of the four basal retaining boots comprise a ground mountable insert that includes a grounding portion configured to be inserted in a ground and a cup-like receiving portion configured to surround and hold an end of one of the first and second support members.

21. The structure as claimed in claim 20, wherein the cup-like receiving portion of each of the four basal retaining boots comprises at least one clamp for fixing the cup-like receiving portion to an end of one of the first and second support members.

22. A toy tent for a young child to play with, comprising:

a base having four sides of substantially equal length and four corners, wherein each of said four sides of said base has a length ranging from about 10 inches to about 60 inches, and said four sides of said b ase form a perimeter of said base;

a canopy having a substantially pyramidal shape, said canopy including four lateral edges, four basal edges, and an apex, said four basal edges forming a perimeter of said canopy, said perimeter of said canopy secured to said perimeter of said base;

an apical retaining loop secured to said canopy at substantially said apex of sad canopy, the apical retaining loop including an upper loop and a lower loop;

four lateral retaining loops, one of said four lateral retaining loops secured to each of said four lateral edges of said canopy, and said four lateral retaining loops spaced equidistant from said apex of said canopy;

four basal retaining boots, one of said four basal retaining boots secured to each of said four lateral edges at a location on each of said four lateral edges adjacent to each of said four corners of said base; and first a nd second support members each comprising a continuous flexible rod, each of said first and second support members passing within and retained by respective ones of the upper and lower apical retaining loops, each of said first and second support members passing within and retained by two of said four lateral retaining loops, and each end of each of said first and second support members inserted into and retained by one of said four basal retaining boots, wherein said first and second support members each have a length ranging from 20–100 inches, and wherein said first and second support members each form a concave arc with respect to said base, and said first and second support members intersect at a point substantially immediately above said apex.

23. A play tent for children to play inside, comprising:

a base having four sides of substantially equal length and four corners;

a canopy having a substantially pyramidal shape, said canopy having four lateral edges, four basal edges, and an apex;

an apical retaining loop secured to the canopy at substantially said apex of said canopy, the apical retaining loop including upper and lower loops;

four lateral retaining loops, one of said four lateral retaining loops secured to each of said four lateral edges of said canopy, and said four lateral retaining loops spaced equidistant from said apex of said canopy;

four basal retaining boots, one of said four basal retaining boots secured to each of said four lateral edges at a location adjacent to each of said four corners of said base; and first and second support members each comprising a continuous flexible rod, each of said first and second support members passing within and retained by respective ones of the upper and lower apical retaining loops, each of said first and second support members passing within and retained by two of said lateral retaining loops, and each end of each of said first and second support members inserted into and retained by one of said four basal retaining boots, wherein said first and second support members each have a length ranging from 100–200 inches, and wherein said first and second support members intersect a point substantially immediately above said apex.

24. The play tent as claimed in claim 23, wherein said four sides of said base form a perimeter of said base, and said four basal edges of said canopy form a perimeter of said canopy, and wherein said perimeter of said canopy is secured to said perimeter of said base.

25. A tent-like structure for human shelter, comprising:

a base having four sides of substantially equal length and four corners;

a canopy having a substantially pyramidal shape, said canopy having four lateral edges, four basal edges, and an apex, each of said four basal edges secured to a corresponding one of said four sides of said base;

an apical retaining loop secured to the canopy at substantially said apex of said canopy, the apical retaining loop including an upper loop and a lower loop;

four lateral retaining loops, one of said four lateral retaining loops secured to each of said four lateral edges of said canopy, and said four lateral retaining loops spaced equidistant from said apex of said canopy;

four basal retaining boots, one of said four basal retaining boots secured to each of said four lateral edges at a location on each of said four lateral edges adjacent to each of said four corners of said base; and first and second support members each comprising a continuous flexible rod, each of said first and second support members passing within and retained by respective ones of the upper and lower apical retaining loops, each of said first and second support members passing within and retained by two of said lateral retaining loops, and each end of each of said first and second support members inserted into and retained by one of said four basal retaining boots, wherein said first and second support members each have a length ranging from 8–72 feet, and a diameter ranging from 1.5–15 inches, and wherein said first and second support members intersect at a point substantially immediately above said apex.

26. A tent-like structure, comprising:

first and second support members;

a base having four corners and four sides, said four sides forming a perimeter of said base; and a canopy comprising first, second, third, and fourth lateral faces, each of said first, second, third, and fourth lateral faces having two lateral sides of substantially equal length and a basal side, said basal side of said first, second, third, and fourth lateral faces attached to said perimeter of said base, and said canopy further having first, second, third, and fourth lateral edges, said canopy further having an apex and said canopy substantially pyramidal in shape, a semi-rigid apical retaining loop attached to said canopy at said apex, the apical retaining loop including an upper loop and a lower loop, wherein the first and second support members pass through respective ones of the upper and lower loops of the apical retaining loop, and said canopy further having first, second, third, and fourth basal retaining boots secured to said first, second, third, and fourth lateral edges, respectively, of said canopy at a position on said first, second, third, and fourth lateral edges adjacent to said base, wherein each of the retaining boots comprises a cup-like enclosure for holding an end of one of the first and second support members.

27. A method for making an easily erected tent-like structure, the method comprising the steps of:

providing a base member, the base member having four corners and four sides;

providing a canopy of the structure, the canopy having four lateral edges and four lateral faces, the four lateral faces having a basal side and two lateral sides;

securing the basal side of one of the four lateral faces of the canopy to each of the four sides of the base member;

providing four retaining boots comprising cup-like enclosures for holding ends of support member;

securing one of the four retaining boots to each of the four lateral edges of the canopy at a position on each of the four lateral edges adjacent to the base member;

providing four retaining loops;

securing one of the four retaining loops to each of the four lateral edges of the canopy;

providing an apical retaining loop having first and second loops for receiving first and second support members, respectively;

securing the apical retaining loop to the apex of the canopy;

providing first and second support members:

inserting the first support member through one of the first and second loops of the apical retaining loop and through two of the retaining loops;

inserting the second support member through the other of the first and second loops of the apical retaining loop and through two of the retaining loops; and inserting the ends of the first and second support members into respective ones of the four retaining boots.

28. The method as claimed in claim 27, wherein said step of securing one of the four retaining loops to each of the four lateral edges of the canopy comprises securing one of the four retaining loops to each of the four lateral edges at a distance from the apex of the canopy of approximately 50% to 60% of the total length of each of the four lateral edges.

29. The method as claimed in claim 27, wherein said step of providing first and second support members comprises providing a pair of continuous, flexible, rods of equal length, wherein each of the first and second support members has a length ranging from about 20 inches to about 70 feet.

30. The method as claimed in claim 27, wherein said step of providing first and second support members comprises providing a pair of continuous, flexible, hollow rods of equal length, and wherein each of the first and second support members has a length ranging from about 1.8 to about 2.2 times the length of each of the four lateral edges of the canopy.

31. A method for making a tent-like structure comprising the steps of:

providing a base, the base having four corners and four sides;

providing first, second, third, and fourth lateral faces of the structure, each of said first, second, third, and fourth lateral faces having two lateral sides of equal length and a basal side;

securing the basal side of the first lateral face to a first side of the base;

securing the basal side of the second lateral face to a second side of the base;

securing the basal side of the third lateral face to a third side of the base;

securing the basal side of the fourth lateral face to a fourth side of the base;

joining the lateral sides of the first, second, third, and fourth lateral sides to form a canopy of the tent-like structure, the canopy having first, second, third, and fourth lateral edges, the canopy further having an apex and the canopy substantially pyramidal in shape;

providing an apical retaining loop including an upper loop and a lower loop;

securing the apical retaining loop to the apex of the canopy;

providing first, second, third, and fourth lateral retaining loops;

securing the first, second, third, and fourth lateral retaining loops to the first, second, third, and fourth lateral edges, respectively, of the canopy;

providing first, second, third, and fourth basal retaining boots comprising cup-like enclosures for holding ends of a support member;

securing the first, second, third, and fourth basal retaining boots to the first, second, third, and fourth lateral edges, respectively, of the canopy at a position on the first, second, third, and fourth lateral edges adjacent to the base;

providing first and second support members;

inserting the first support member through one of the upper and lower loops of the apical retaining loop and through two of the lateral retaining loops;

inserting the second support member through the other of the upper and lower loops of the apical retaining loop and through two of the lateral retaining loops; and inserting the ends of the first and second support members into respective ones of the basal retaining boots.

32. The method as claimed in claim 31, wherein said step of securing the first, second, third, and fourth lateral retaining loops to the first, second, third, and fourth lateral edges, respectively, of the canopy comprises securing the first, second, third, and fourth lateral retaining loops to the first, second, third, and fourth lateral edges, respectively, at a distance from the apex of the canopy approximately 50% to 60% of the total length of each of the four lateral edges.

33. The method as claimed in claim 31, wherein said step of providing first and second support members comprises providing a pair of continuous, flexible, rods of equal length.

34. A method of erecting a tent-like structure, comprising the steps of:

providing a base, the base having four corners and four sides of substantially equal length, the four sides forming a perimeter of the base;

providing a canopy comprising first, second, third, and fourth lateral faces, each of said first, second, third, and fourth lateral faces of equal size and each of said first, second, third, and fourth lateral faces having two lateral sides of equal length and a basal side, the basal side of the first, second, third, and fourth lateral faces attached to the perimeter of the base, and the canopy further having first, second, third, and fourth lateral edges, the canopy further having an apex and the canopy substantially pyramidal in shape, an apical retaining loop, including an upper loop and a lower loop, attached to the canopy at the apex, and the canopy further having first, second, third, and fourth lateral retaining loops secured to the first, second, third, and fourth lateral edges, respectively, of the canopy, and the canopy further having first, second, third, and fourth basal retaining boots secured to the first, second, third, and fourth lateral edges, respectively, of the canopy at a position on the first, second, third, and fourth lateral edges adjacent to the base;

providing first and second support members;

passing the first support member through the first lateral retaining loop, through the one of the upper and lower loops of the apical retaining loop, and through the third lateral retaining loop;

passing the second support member through the second lateral retaining loop, through the other of the upper and lower loops of the apical retaining loop, and through the fourth lateral retaining loop;

inserting a first end of the first support member into the first basal retaining boot and inserting a second end of the first support member into the third basal retaining boot; and inserting a first end of the second support member into the second basal retaining boot and inserting a second end of the second support member into the fourth basal retaining boot.

35. A method for providing a tent in the disassembled state, comprising the steps of:

providing first, second, third, and fourth lateral faces of a tent canopy, each of the first, second, third, and fourth lateral faces having left and right sides and a basal side;

providing a base of the tent, the base having first, second, third, and fourth sides;

providing a portal in the fourth lateral face;

attaching first and fourth basal retaining boots comprising cup-like enclosures for holding an end of a support member to the fourth lateral face;

attaching second and third basal retaining boots comprising cup-like enclosures for holding an end of a support member to the second lateral face;

attaching first and fourth lateral retaining loops to the fourth lateral face;

attaching second and third lateral retaining loops to the second lateral face;

attaching the right side of the fourth lateral face to the left side of the third lateral face to form a first half canopy of the tent canopy;

attaching the right side of the second lateral face to the left side of the first lateral face to form a second half canopy of the tent canopy;

attaching a single-piece apical retaining loop to a nascent apex of the tent canopy of the first or the second half canopy, the single-piece apical retaining loop including a closed upper loop and a closed lower loop;

joining the first half canopy to the second half canopy to form a tent canopy having first, second, third, and fourth basal edges;

attaching each of the first, second, third, and fourth basal edges of the tent canopy to a corresponding first, second, third, and fourth side of the base to form a combined tent base and canopy;

inverting the combined tent base and canopy through the portal; and providing first and second support members for passing through and being retained in respective ones of the upper and lower loops of the single-piece apical retaining loop.

* * * * *